US009726405B2

(12) United States Patent
Kawano et al.

(10) Patent No.: US 9,726,405 B2
(45) Date of Patent: Aug. 8, 2017

(54) EJECTOR AND HEAT PUMP APPARATUS INCLUDING THE SAME

(71) Applicant: Panasonic Intellectual Property Management Co., Ltd., Osaka (JP)

(72) Inventors: Bunki Kawano, Osaka (JP); Tomoichiro Tamura, Osaka (JP); Takahiro Matsuura, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 169 days.

(21) Appl. No.: 14/881,024

(22) Filed: Oct. 12, 2015

(65) Prior Publication Data

US 2016/0033183 A1 Feb. 4, 2016

Related U.S. Application Data

(63) Continuation of application No. PCT/JP2014/003863, filed on Jul. 23, 2014.

(30) Foreign Application Priority Data

Aug. 5, 2013 (JP) ..... 2013-162688

(51) Int. Cl.
*F25B 41/00* (2006.01)
*F04F 5/04* (2006.01)
(Continued)

(52) U.S. Cl.
CPC ..... *F25B 41/00* (2013.01); *F04F 5/04* (2013.01); *F04F 5/46* (2013.01); *F04F 5/463* (2013.01);
(Continued)

(58) Field of Classification Search
CPC .... F04F 5/463; F04F 5/46; F04F 5/467; F04F 5/04; F25B 41/00; F25B 43/00; F25B 2400/23; F25B 2341/0012
See application file for complete search history.

(56) References Cited

U.S. PATENT DOCUMENTS 924,335 A 6/1909 Frame
4,101,073 A * 7/1978 Curran ..... F04F 5/462 239/14.2
(Continued)

FOREIGN PATENT DOCUMENTS

CN 101419000 A 4/2009
CN 202212297 U 5/2012
(Continued)

OTHER PUBLICATIONS

International Search Report of PCT application No. PCT/JP2014/003863 dated Oct. 28, 2014.
(Continued)

*Primary Examiner* — Emmanuel Duke
(74) *Attorney, Agent, or Firm* — McDermott Will & Emery LLP

(57) ABSTRACT

An ejector includes a first nozzle, a second nozzle, an atomization mechanism, and a mixer. A working fluid in a liquid phase is supplied to the first nozzle as a drive flow. A working fluid in a gas phase is sucked into the second nozzle. The atomization mechanism is disposed at an end of the first nozzle and atomizes the working fluid in a liquid phase while maintaining the liquid phase. The mixer generates a fluid mixture by mixing the atomized working fluid generated by the atomization mechanism and the working fluid in a gas phase sucked into the second nozzle. The atomization mechanism includes an ejection section that generates a jet of the working fluid in a liquid phase and a collision surface with which the jet from the ejection section
(Continued)

collides. The collision surface is inclined with respect to a direction in which the jet flows.

19 Claims, 14 Drawing Sheets

(51) Int. Cl.
*F04F 5/46* (2006.01)
*F25B 43/00* (2006.01)

(52) U.S. Cl.
CPC ..... *F04F 5/467* (2013.01); *F25B 43/00* (2013.01); *F25B 2341/0012* (2013.01); *F25B 2400/13* (2013.01); *F25B 2400/23* (2013.01)

(56) References Cited

U.S. PATENT DOCUMENTS 4,160,526 A * 7/1979 Flanagan ..... F23C 9/00 239/427
5,343,711 A * 9/1994 Kornhauser ..... F25B 1/06 417/198
6,438,993 B2 * 8/2002 Takeuchi ..... F04F 5/04 62/191
6,877,960 B1 * 4/2005 Presz, Jr. ..... F04F 5/46 417/183
7,165,948 B2 * 1/2007 Takeuchi ..... F04F 5/04 417/195
2004/0060996 A1 * 4/2004 Jansohn ..... B05B 7/065 239/8
2004/0103685 A1 * 6/2004 Yamaguchi ..... B60H 1/00899 62/500
2013/0111944 A1 * 5/2013 Wang ..... F25B 41/00 62/500
2013/0277448 A1 * 10/2013 Liu ..... F04F 5/461 239/11

FOREIGN PATENT DOCUMENTS

| | | |
|---|---|---|
| FR | 736138 | 11/1932 |
| JP | 62-272000 | 11/1987 |
| JP | 6-002964 | 1/1994 |
| JP | 2001-200800 | 7/2001 |
| JP | 2008-122012 | 5/2008 |
| JP | 2010-196919 | 9/2010 |

OTHER PUBLICATIONS

The Extended European Search Report dated Jul. 22, 2016 for the related European Patent Application No. 14834529.1.
English Translation of Chinese Search Report dated Feb. 4, 2017 for the related Chinese Patent Application No. 201480003407.8.

* cited by examiner

EJECTOR AND HEAT PUMP APPARATUS INCLUDING THE SAME

BACKGROUND

1. Technical Field

The present disclosure relates to an ejector and a heat pump apparatus including the ejector.

2. Description of the Related Art

Ejectors are used as decompression means of various apparatuses, such as vacuum pumps and refrigeration cycle apparatuses. As illustrated in FIG. 10, a refrigeration cycle apparatus 200 described in Japanese Patent No. 3158656 includes a compressor 102, a condenser 103, an ejector 104, a separator 105, and an evaporator 106. The ejector 104 receives a refrigerant liquid as a drive flow from the condenser 103, sucks in and pressurizes a refrigerant vapor supplied from the evaporator 106, and ejects the refrigerant liquid and the refrigerant vapor toward the separator 105. The separator 105 separates the refrigerant liquid and the refrigerant vapor from each other. The compressor 102 sucks in the refrigerant vapor pressurized by the ejector 104. Thus, the compression work to be done by the compressor 102 is reduced and the COP (coefficient of performance) of a refrigeration cycle is improved.

As illustrated in FIG. 11, the ejector 104 includes a nozzle 140, a suction port 141, a mixer 142, and a pressurizer 143. A plurality of connection ports 144, through which the inside of the nozzle 140 is connected to the outside of the nozzle 140, are disposed near the outlet of the nozzle 140. The refrigerant vapor is sucked into the ejector 104 through the suction ports 141. A part of the refrigerant vapor sucked into the ejector 104 flows to the inside of the nozzle 140 through the connection ports 144.

The nozzle 140 of the ejector 104 has a tapering section near the outlet thereof. In the tapering section, the flow velocity of the refrigerant increases and the pressure of the refrigerant decreases. Accordingly, the phase of the refrigerant (drive flow), which is supplied to the nozzle 140, changes from a liquid phase to a gas-liquid two-phase in the tapering section. In other words, the ejector 104 illustrated in FIG. 11 is called a "two-phase flow ejector".

SUMMARY

The performance of an ejector depends on whether transfer of momentum between a drive flow and a suction flow can be efficiently performed. One non-limiting and exemplary embodiment provides a technology for improving the performance of an ejector.

In one general aspect, the techniques disclosed here feature an ejector including a first nozzle to which a working fluid in a liquid phase is supplied, a second nozzle into which a working fluid in a gas phase is sucked, an atomization mechanism that is disposed at an end of the first nozzle and that atomizes the working fluid in a liquid phase while maintaining the liquid phase, and a mixer that generates a fluid mixture by mixing the atomized working fluid generated by the atomization mechanism with the working fluid in a gas phase sucked into the second nozzle. The atomization mechanism includes (a) an ejection section that generates a jet of the working fluid in a liquid phase, and (b) a collision surface with which the jet from the ejection section collides, and the collision surface is inclined with respect to a direction in which the jet flows.

According to the technology described above, the momentum of a working fluid in a liquid phase (drive flow) can be efficiently transferred to a working fluid in a gas phase (suction flow). Accordingly, the performance of the ejector is improved.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
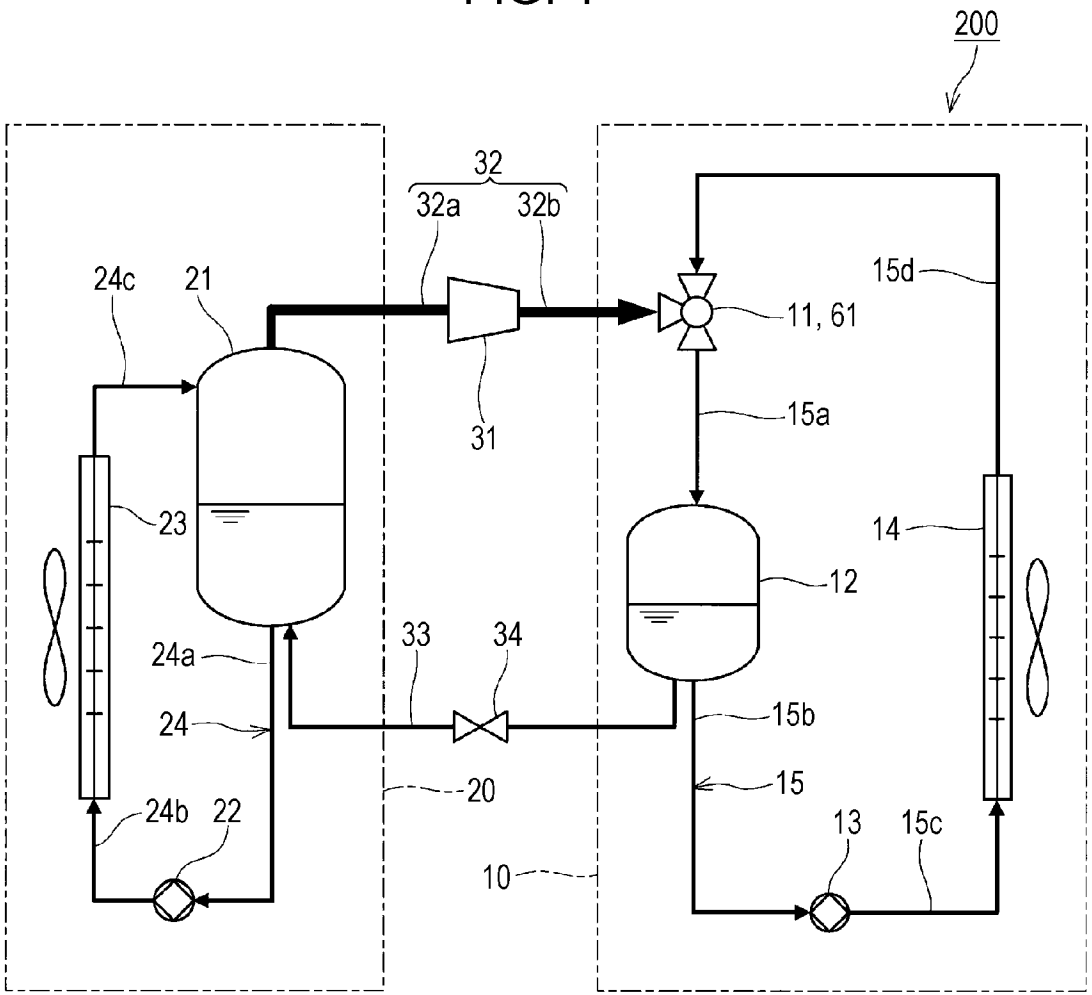
FIG. 1 is a block diagram of a heat pump apparatus according to an embodiment of the present disclosure.

Findings on which the Present Disclosure is Based

If a drive flow is a gas or a two-phase flow with a large void fraction and a suction flow is a gas, momentum can be efficiently transferred between the drive flow and the suction flow by simply mixing the drive flow and the suction flow. However, if a drive flow is a liquid and a suction flow is a gas, momentum cannot be smoothly transferred from the drive flow to the suction flow, because the relaxation time of velocity (time required for the velocity of the drive flow and the velocity of the suction flow to become substantially equal to each other) is large. As a result, an ejector cannot be driven efficiently.

If a drive flow is a liquid and a suction flow is a gas, a mixing chamber of an ejector is filled with a two-phase flow. Transfer of momentum from the drive flow to the suction flow occurs mainly due to a drag force, which is caused by viscous drag or the like. When the liquid is ejected into the mixing chamber filled with the gas, a gas-liquid two-phase spray flow, in which the dispersed phase is droplets of the liquid and the continuous phase is the gas, is generated. In a two-phase flow in which a dispersed phase and a continuous phase have relative velocities, transfer of momentum is governed by the equation of motion of liquid droplets. According to the equation of motion of liquid droplets, momentum can be transferred in a shorter time as the contact area between the liquid droplets and the gas becomes larger. In other words, when adhesion of liquid droplets to an inner wall of the ejector and pressure loss of the two-phase flow are taken into consideration, momentum can be more efficiently transferred as the sum of the surface areas of the liquid droplets becomes larger (as the diameters of individual liquid droplets become smaller).

On the basis of the findings described above, the inventors have focused on supplying a microspray flow into a mixing chamber by actively atomizing a drive flow.

An ejector according to a first aspect of the present disclosure includes a first nozzle to which a working fluid in a liquid phase is supplied, a second nozzle into which a working fluid in a gas phase is sucked, an atomization mechanism that is disposed at an end of the first nozzle and that atomizes the working fluid in a liquid phase while maintaining the liquid phase, and a mixer that generates a fluid mixture by mixing the atomized working fluid generated by the atomization mechanism with the working fluid in a gas phase sucked into the second nozzle. The atomization mechanism includes (a) an ejection section that generates a jet of the working fluid in a liquid phase, and (b) a collision surface with which the jet from the ejection section collides, and the collision surface is inclined with respect to a direction in which the jet flows.

With the first aspect, the working fluid in a liquid phase is atomized by the atomization mechanism and supplied to the mixer. The mixer generates a fluid mixture by mixing the atomized working fluid with the working fluid in a gas phase. The fluid mixture is in the form of a microspray flow. By atomizing the working fluid in a liquid phase, the contact area between the working fluid in a liquid phase and the working fluid in a gas phase is increased. Accordingly, with the ejector according to the first aspect, the momentum of the working fluid in a liquid phase (drive flow) is efficiently transferred to the working fluid in a gas phase (suction flow), and the pressure can be increased. In other words, the present disclosure can provide an ejector having a high performance. Moreover, because the collision surface is inclined with respect to the direction in which the jet flows, the collision surface receives a reactional force in accordance with the inclination angle. In other words, by forming the collision surface so as to be inclined, occurrence of a loss of the momentum of the working fluid in a liquid phase can be suppressed.

In a second aspect of the present disclosure, in addition to the first aspect, for example, an entirety of the jet generated by the ejection section of the ejector collides with the collision surface. In other words, the positional relationship between the ejection section and the collision surface is determined so that the entirety of the jet collides with the collision surface. In other words, the collision surface has such a size that the collision surface covers the entirety a projected region when the diameter of the ejection section is projected onto the collision surface. With the second aspect, the jet can be efficiently atomized, and therefore the potential of the ejector can be fully exploited.

In a third aspect of the present disclosure, in addition to the first or second aspect, for example, the ejection section includes a plurality of orifices. By ejecting a working fluid from the orifices, a jet having a sufficiently large momentum can be made to collide with the collision surface.

In a fourth aspect of the present disclosure, in addition to the third aspect, the plurality of orifices are disposed around a central axis of the first nozzle, and each of the orifices extends in a direction parallel to the central axis. With the fourth aspect, the atomized working fluid can be evenly supplied to the mixer. By ejecting the working fluid from the orifices, a jet having a sufficiently large momentum can be made to collide with the collision surface. By using the orifices, it is possible to make the working fluid flow at a sufficiently high flow rate.

In a fifth aspect of the present disclosure, in addition to the third aspect, the plurality of orifices are disposed around a central axis of the first nozzle, and each of the orifices extends in a direction inclined with respect to the central axis, and the collision surface is a cylindrical surface that surrounds the central axis of the first nozzle at a position that is farther from the central axis than positions at which the plurality of orifices are disposed.

In a sixth aspect of the present disclosure, in addition to any one of the third to fifth aspects, the plurality of orifices are arranged along double circles, each of which imaginarily surrounds a central axis of the first nozzle. With the sixth aspect, the working fluid can flow at a sufficiently high flow rate. Moreover, it may be possible to accelerate atomization of the working fluid due to collision between a jet generated at orifices located near a central axis of the first nozzle and a jet generated at orifices located far from the central axis of the first nozzle.

In a seventh aspect of the present disclosure, in addition to any one of the third to sixth aspects, a cross-sectional area of each of the plurality of orifices is constant in a direction of flow of the working fluid. With the seventh aspect, the phase of the working fluid does not easily change from a liquid phase to a gas-liquid two-phase.

In an eighth aspect of the present disclosure, in addition to the first or second aspect, the ejection section includes a slit. By ejecting the working fluid from the slit, a jet having a sufficiently large momentum can be made to collide with the collision surface.

In a ninth aspect of the present disclosure, in addition to the eighth aspect, the slit is disposed around a central axis of the first nozzle and extends in a direction parallel to the central axis of the first nozzle. With the ninth aspect, the atomized working fluid can be evenly supplied to the mixer. By ejecting the working fluid from the slit, a jet having a sufficiently large momentum can be made to collide with the collision surface.

In a tenth aspect of the present disclosure, in addition to the eighth aspect, the slit is disposed around a central axis of the first nozzle and extends in a direction inclined with respect to the central axis, and the collision surface is a cylindrical surface that surrounds the central axis of the first nozzle at a position that is farther from the central axis than a position at which the slit is disposed. With the tenth aspect, the atomized working fluid can be evenly supplied to the mixer. By ejecting the working fluid from the slit, a jet having a sufficiently large momentum can be made to collide with the collision surface.

In an eleventh aspect of the present disclosure, in addition to any one of the eighth to tenth aspects, the slit is arranged along double circles, each of which imaginarily surrounds a central axis of the first nozzle. With the eleventh aspect, the working fluid can flow at a sufficiently high flow rate. Moreover, it may be possible to accelerate atomization of the working fluid due to collision between a jet generated at a slit located near a central axis of the first nozzle and a jet generated at a slit located far from the central axis of the first nozzle.

In a twelfth aspect of the present disclosure, in addition to any one of the eighth to eleventh aspects, a cross-sectional area of the slit is constant in a direction of flow of the working fluid. With the twelfth aspect, the phase of the working fluid does not easily change from a liquid phase to a gas-liquid two-phase when the working fluid passes through the slit.

In a thirteenth aspect of the present disclosure, in addition to any one of the first to twelfth aspects, the collision surface is disposed between the ejection section and an inner wall of the mixer and directs toward the inner wall a jet that is ejected from the ejection section and that is made to collide with the collision surface. With the thirteenth aspect, occurrence of a loss of the momentum of the jet due to direct collision of the jet with the inner wall of the mixer can be avoided.

In a fourteenth aspect of the present disclosure, in addition to any one of the first to thirteenth aspects, the atomization mechanism is a single-fluid atomization mechanism. The structure of a single-fluid atomization mechanism is simple. Therefore, a single-fluid atomization mechanism is less expensive than a two-fluid type atomization mechanism.

In a fifteenth aspect of the present disclosure, in addition to any one the first to fourteenth aspects, the ejector further includes a discharger that discharges the fluid mixture to the outside, and the discharger includes a diffuser that recovers a static pressure by decelerating the fluid mixture. The diffuser reduces the velocity of the fluid mixture, thereby recovering the static pressure of the fluid mixture.

A heat pump apparatus according to a sixteenth aspect of the present disclosure includes a compressor that compresses a refrigerant vapor; a heat exchanger through which a refrigerant liquid flows; the ejector according to any one of the first to fifteenth aspects, the ejector generating a refrigerant mixture by using the refrigerant vapor compressed by the compressor and the refrigerant liquid flowing from the heat exchanger; an extractor that receives the refrigerant mixture from the ejector and that extracts the refrigerant liquid from the refrigerant mixture; a liquid path that extends from the extractor to the ejector via the heat exchanger; and an evaporator that stores the refrigerant liquid and that generates the refrigerant vapor, which is to be compressed by the compressor, by evaporating the refrigerant liquid.

With the sixteenth aspect, the refrigerant liquid supplied to the ejector is used as a drive flow, and the refrigerant vapor from the compressor is sucked into the ejector. The ejector generates a refrigerant mixture by using the refrigerant liquid and the refrigerant vapor. Thus, the work to be done by the compressor can be reduced, so that the heat pump apparatus can have an efficiency that is equivalent to or higher than those of existing heat pump apparatuses while considerably reducing the compression ratio of the compressor. Moreover, the heat pump apparatus can be reduced in size.

In a seventeenth aspect of the present disclosure, in addition to the sixteenth aspect, a pressure of the refrigerant mixture discharged from the ejector is higher than a pressure of the refrigerant vapor sucked into the ejector and lower than a pressure of the refrigerant liquid supplied to the ejector. With the seventeenth aspect, the pressure of the refrigerant can be efficiently increased.

In an eighteenth aspect of the present disclosure, in addition to the sixteenth or seventeenth aspect, the refrigerant is a refrigerant whose saturated vapor pressure at room temperature is a negative pressure. By atomizing the working fluid in a liquid phase using the ejector according to any one of the first to fifteenth aspects, the contact area between the working fluid in a liquid phase and working fluid in a gas phase is increased. Thus, the momentum of the working fluid in a liquid phase (drive flow) can be efficiently transferred to the working fluid in a gas phase (suction flow), and the pressure inside the ejector can be increased. Therefore, even if a refrigerant whose saturated vapor pressure at room temperature is a negative pressure, such as water, is used, the efficiency of the heat pump apparatus can be increased.

In a nineteenth aspect of the present disclosure, in addition to any one the sixteenth to eighteenth aspects, the refrigerant includes water as a main component. According to the nineteenth aspect, in addition to any one of the sixteenth to eighteenth aspects, the refrigerant includes water as a main component. The environmental load of a refrigerant including water as a main component is small.

An ejector according to a twentieth aspect of the present disclosure includes a first nozzle to which a working fluid in a liquid phase is supplied; a second nozzle into which a working fluid in a gas phase is sucked; a mixer that generates a fluid mixture by mixing the working fluid in a liquid phase supplied to the first nozzle and the working fluid in a gas phase sucked into the second nozzle; and an atomization mechanism disposed at an end of the first nozzle, the atomization mechanism including (i) an ejection section having an orifice or a slit that connects the first nozzle to the mixer, and (ii) a collision surface with which a jet generated by the ejection section is to collide so that the working fluid in a liquid phase is atomized and supplied to the mixer, the collision surface being inclined with respect to a direction in which the jet flows.

The twentieth aspect provides the same advantages as the first aspect and the second aspect.

Hereinafter, embodiments of the present disclosure will be described with reference to the drawings. Note that the present disclosure is not limited to the embodiments described below.

As illustrated in FIG. 1, a heat pump apparatus 200 (refrigeration cycle apparatus) according to the present embodiment includes a first heat exchange unit 10, a second heat exchange unit 20, a compressor 31, and a vapor path 32. The first heat exchange unit 10 and the second heat exchange unit 20 are respectively a heat releasing circuit and a heat absorbing circuit. A refrigerant vapor generated by the second heat exchange unit 20 is supplied to the first heat exchange unit 10 via the compressor 31 and the vapor path 32.

The heat pump apparatus 200 is filled with a refrigerant whose saturated vapor pressure is a negative pressure (an absolute pressure lower than the atmospheric pressure) at room temperature (JIS: 20° C.±15° C./JIS Z8703). An example of such a refrigerant is a refrigerant including water, alcohol, or ether as a main component. When the heat pump apparatus 200 is in operation, the pressure of the inside of the heat pump apparatus 200 is lower than the atmospheric pressure. The pressure at the inlet of the compressor 31 is, for example, in the range of 0.5 to 5 kPaA. The pressure at the outlet of the compressor 31 is, for example, in the range of 5 to 15 kPaA. In order to prevent freezing or the like, a refrigerant including water as a main component and other components, such as ethylene glycol, Nybrine, and inorganic salts, in 10 to 40 mass % may be used as the refrigerant. The term "main component" refers to a component included in the refrigerant with the largest mass percent.

The first heat exchange unit 10 includes an ejector 11, a first extractor 12, a first pump 13, and a first heat exchanger 14. The ejector 11, the first extractor 12, the first pump 13, and the first heat exchanger 14 are connected through pipes 15*a* to 15*d* in this order in a ring-like shape.

The ejector 11 is connected to the first heat exchanger 14 through the pipe 15*d* and is connected to the compressor 31 through the vapor path 32. The refrigerant liquid flowing from the first heat exchanger 14 is supplied to the ejector 11 as a drive flow, and the refrigerant vapor compressed by the compressor 31 is supplied to the ejector 11 as a suction flow. The ejector 11 generates a refrigerant mixture having a small quality (dryness) and supplies the refrigerant mixture to the first extractor 12. The refrigerant mixture is a refrigerant in a liquid phase or in a gas-liquid two-phase with a very small quality.

The first extractor 12 receives the refrigerant mixture from the ejector 11 and extracts the refrigerant liquid from the refrigerant mixture. In other words, the first extractor 12 serves as a vapor liquid separator that separates the refrigerant liquid and the refrigerant vapor from each other. Basically, the first extractor 12 extracts only the refrigerant liquid. The first extractor 12 includes, for example, a pressure-resistant container having a heat insulation property. However, the first extractor 12 may have any appropriate structure as long as the first extractor 12 can extract the refrigerant liquid. The pipes 15*b* to 15*d* form a liquid path 15 extending from the first extractor 12 to the ejector 11 via the first heat exchanger 14. The first pump 13 is disposed in the liquid path 15 at a position between a liquid outlet of the first extractor 12 and an inlet of the first heat exchanger 14. The first pump 13 moves the refrigerant liquid stored in the first extractor 12 to the first heat exchanger 14. The discharge pressure of the first pump 13 is lower than the atmospheric pressure. The first pump 13 is disposed at such a position that the available suction head, which is defined in consideration of the height from a suction port of the first pump 13 to a liquid surface in the first extractor 12, is larger than the required suction head (required NPSH). The first pump 13 may be disposed between an outlet of the first heat exchanger 14 and a liquid inlet of the ejector 11.

The first heat exchanger 14 is a heat exchanger of a known type, such as a fin tube heat exchanger or a shell tube heat exchanger. If the heat pump apparatus 200 is an air-conditioning apparatus for cooling air in a room, the first heat exchanger 14 is disposed outside of the room and heats air outside the room by using the refrigerant liquid.

The second heat exchange unit 20 includes an evaporator 21, a pump 22 (third pump), and a second heat exchanger 23. The evaporator 21 stores a refrigerant liquid and generates a refrigerant vapor, which is to be compressed by the compressor 31, by evaporating the refrigerant liquid. The evaporator 21, the pump 22, and the second heat exchanger 23 are connected to each other through pipes 24*a* to 24*c* in a ring-like shape. The evaporator 21 includes, for example, a pressure-resistant container having a heat insulation property. The pipes 24*a* to 24*c* form a circulation path 24, along which the refrigerant liquid stored in the evaporator 21 is circulated via the second heat exchanger 23. The pump 22 is disposed in the circulation path 24 at a position between a liquid outlet of the evaporator 21 and an inlet of the second heat exchanger 23. The pump 22 moves the refrigerant liquid stored in the evaporator 21 to the second heat exchanger 23. The discharge pressure of the pump 22 is lower than the atmospheric pressure. The pump 22 is disposed at such a position that the height from a suction port of the pump 22 to a liquid surface in the evaporator 21 is larger than the required suction head (required NPSH).

The second heat exchanger 23 is a heat exchanger of a known type, such as a fin tube heat exchanger or a shell tube heat exchanger. If the heat pump apparatus 200 is an air-conditioning apparatus for cooling air in a room, the second heat exchanger 23 is disposed inside of the room and cools air inside the room by using the refrigerant liquid.

In the present embodiment, the evaporator 21 is a heat exchanger that directly evaporates a refrigerant liquid, which has been heated while circulating along the circulation path 24. The refrigerant liquid stored in the evaporator 21 directly contacts a refrigerant liquid circulating along the circulation path 24. In other words, a part of the refrigerant liquid in the evaporator 21 is heated by the second heat exchanger 23 and is used as a heat source for heating a refrigerant liquid in a saturated state. Preferably, an upstream end of the pipe 24*a* is connected to a lower part of the evaporator 21. Preferably, a downstream end the pipe 24*c* is connected to a middle part of the evaporator 21. The second heat exchange unit 20 may be structured so that a refrigerant liquid stored in the evaporator 21 may not be mixed with another refrigerant liquid circulating along the circulation path 24. For example, if the evaporator 21 is structured as a heat exchanger, such as a shell tube heat exchanger, it is possible to heat and evaporate the refrigerant liquid stored in the evaporator 21 by using a heating medium circulating along the circulation path 24. The heating medium, for heating the refrigerant liquid stored in the evaporator 21, flows through the second heat exchanger 23.

The vapor path 32 includes an upstream portion 32*a* and a downstream portion 32*b*. A compressor 31 is disposed in the vapor path 32. The upstream portion 32*a* of the vapor path 32 connects an upper part of the evaporator 21 to a suction port of the compressor 31. The downstream portion 32*b* of the vapor path 32 connects a discharge hole of the compressor 31 to a second nozzle 41 of the ejector 11. The compressor 31 is a centrifugal compressor or a positive displacement compressor. A plurality of compressors may be disposed in the vapor path 32. The compressor 31 sucks in a refrigerant vapor from the evaporator 21 of the second heat exchange unit 20 through the upstream portion 32*a* and compresses the refrigerant vapor. The compressed refrigerant vapor is supplied to the ejector 11 through the downstream portion 32*b*.

With the present embodiment, the temperature and the pressure of the refrigerant are increased in the ejector 11. Thus, the work to be done by the compressor 31 can be reduced, and therefore the heat pump apparatus 200 can have an efficiency that is equivalent to or higher than those of existing heat pump apparatuses, while considerably reducing the compression ratio of the compressor 31. Moreover, the size of the heat pump apparatus 200 can be reduced.

The heat pump apparatus 200 is not limited to an air-conditioning apparatus that can perform only a cooling operation. A flow passage switching device, such as a four-way valve or a three-way valve, may be provided so that the first heat exchanger 14 can function as a heat exchanger for absorbing heat and the second heat exchanger 23 can function as a heat exchanger for releasing heat. In this case, an air-conditioning apparatus that can selectively perform a cooling operation and a heating operation can be obtained. The heat pump apparatus 200 is not limited to an air-conditioning apparatus and may be a different apparatus, such as a chiller or a heat storage apparatus. An object to be heated by the first heat exchanger 14 and cooled by the second heat exchanger 23 may be a gas other than air or a liquid.

A return path 33 for returning a refrigerant from the first heat exchange unit 10 to the second heat exchange unit 20 may be provided. An expansion mechanism 34, such as a capillary or an expansion valve, is disposed in the return path 33. In the present embodiment, the first extractor 12 is connected to the evaporator 21 through the return path 33 so that a refrigerant stored in the first extractor 12 can be transferred to the evaporator 21. Typically, a lower part of the first extractor 12 is connected to a lower part of the evaporator 21 through the return path 33. The refrigerant liquid is returned from the first extractor 12 to the evaporator 21 through the return path 33 while being decompressed by the expansion mechanism 34.

The return path 33 may branch off from any part of the first heat exchange unit 10. For example, the return path 33 may branch off from the pipe 15*a*, which connects the ejector 11 to the first extractor 12, or may branch off from an upper part of the first extractor 12. It is not necessary that a refrigerant be returned from the first heat exchange unit 10 to the second heat exchange unit 20. For example, the first heat exchange unit 10 may be structured so that a residual refrigerant can be discharged therefrom as necessary, and the second heat exchange unit 20 may be structured so that a refrigerant can be additionally supplied thereto as necessary.

Next, an operation of the heat pump apparatus 200 will be described.

Figure 12:
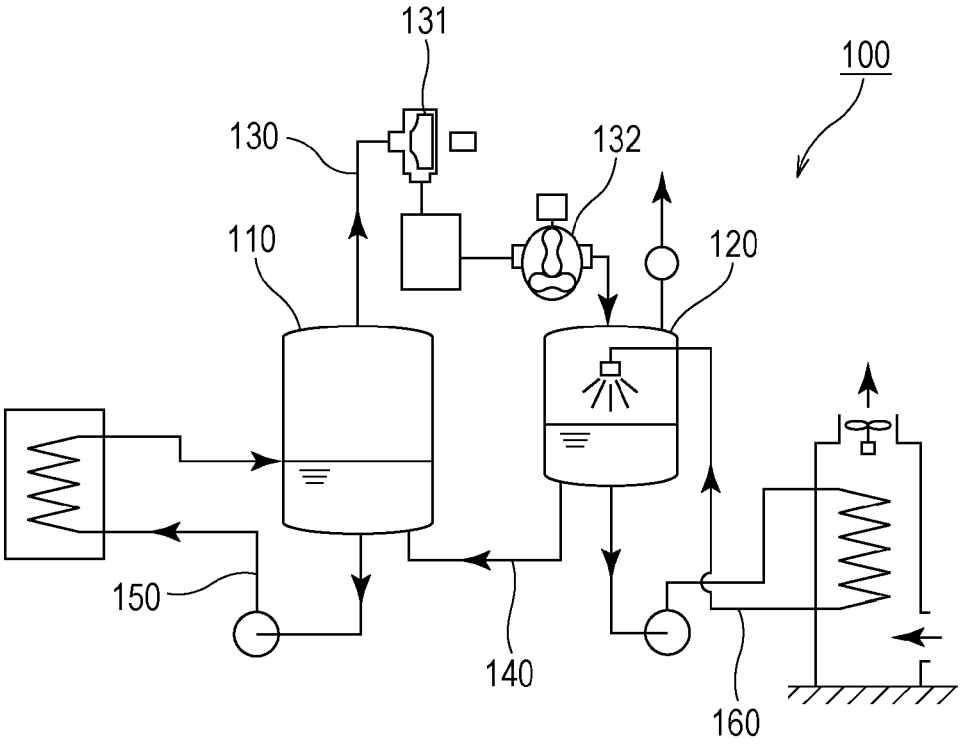
FIG. 12 is a block diagram of another existing refrigeration cycle apparatus.
Figure 13:
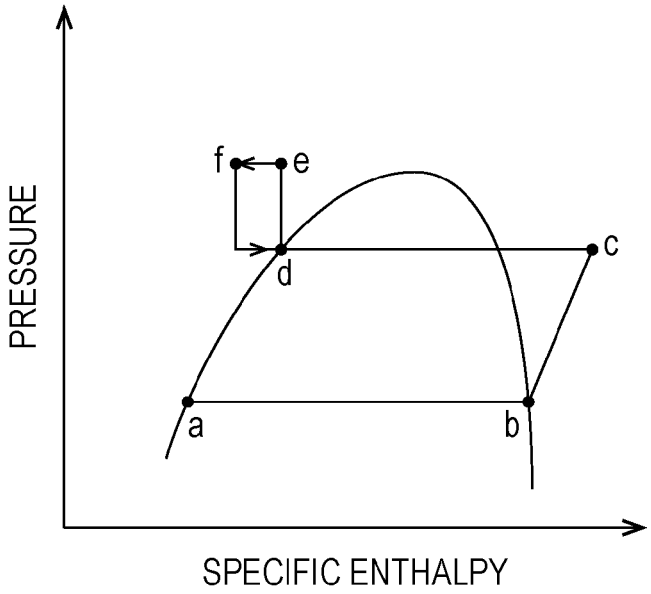
FIG. 13 is a Mollier diagram of the refrigeration cycle apparatus illustrated in FIG. 12.

FIG. 12 illustrates an existing refrigeration cycle apparatus 100, which does not have an ejector (see, for example, Japanese Unexamined Patent Application Publication No. 2008-122012). FIG. 13 illustrates a Mollier diagram of the refrigeration cycle apparatus 100. As illustrated in FIG. 12, the refrigeration cycle apparatus 100 includes an evaporator 110, a condenser 120, a first circulation path 150, and a second circulation path 160. An upper part of the evaporator 110 is connected to an upper part of the condenser 120 through a first connection path 130. Compressors 131 and 132 are disposed in the first connection path 130. A lower part of the evaporator 110 is connected to a lower part of the condenser 120 through a second connection path 140. As illustrated in FIG. 13, a refrigerant liquid stored in the evaporator 110 evaporates in the evaporator 110 and changes into a refrigerant vapor (from point a to point b). The refrigerant vapor is compressed by the compressors 131 and 132 (from point b to point c). For simplicity, an intermediate cooler, which is disposed between the compressor 131 and the compressor 132, is neglected. The compressed refrigerant vapor is cooled and condensed by the condenser 120 (from point c to point d). A refrigerant liquid stored in the condenser 120 is moved by a pump to a heat exchanger (from point d to point e). The refrigerant liquid is cooled by the heat exchanger (from point e to point f). The cooled refrigerant liquid is returned to the condenser 120 (from point f to point d). A part of the refrigerant liquid is returned to the evaporator 110 through the second connection path 140 (from point d to point a).

Figure 2:
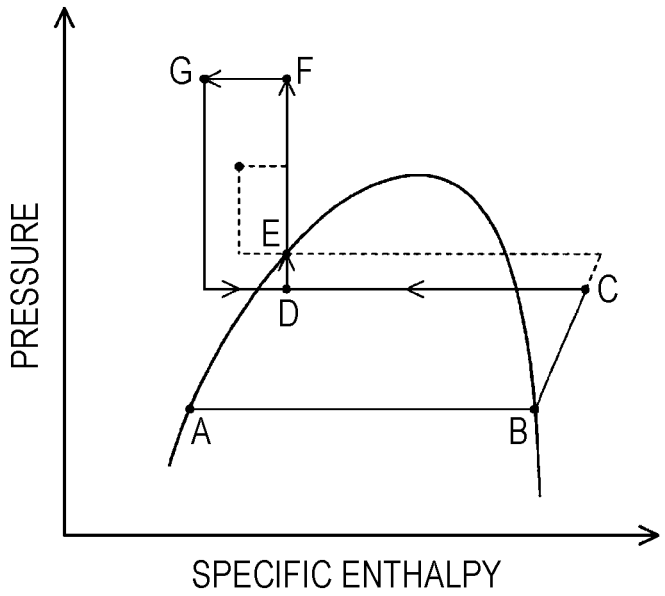
FIG. 2 is a Mollier diagram of the heat pump apparatus illustrated in FIG. 1.

FIG. 2 is a Mollier diagram of the heat pump apparatus 200 according to the present embodiment. A broken line represents a part of the cycle illustrated in FIG. 13. A refrigerant liquid stored in the evaporator 21 evaporates in the evaporator 21 and changes into a refrigerant vapor (from point A to point B). The refrigerant vapor is compressed by the compressor 31 (from point B to point C). The compressed refrigerant vapor is sucked into the ejector 11 and mixed with a refrigerant liquid flowing from the first heat exchanger 14 (from point C to point D). A refrigerant mixture of the refrigerant vapor and the refrigerant liquid is heated and pressurized by the ejector 11 (from point D to point E). To be specific, in the ejector 11, the refrigerant vapor is compressed while releasing heat. Accordingly, the temperature of the refrigerant mixture is increased. The refrigerant mixture is a refrigerant in a liquid phase or in a gas-liquid two-phase. The state of refrigerant at the outlet of the ejector 11 varies in accordance with the operating conditions of the heat pump apparatus 200. Ideally, the refrigerant is entirely in a liquid phase at the outlet of the ejector 11, that is, the quality of the refrigerant is zero. The refrigerant mixture is supplied from the ejector 11 to the first extractor 12 and separated into a refrigerant liquid and a refrigerant vapor. The refrigerant liquid stored in the first extractor 12 is moved by the first pump 13 to the first heat exchanger 14 (from point E to point F). The refrigerant liquid is cooled by the first heat exchanger 14 (from point F to point G). The first heat exchanger 14 cools the refrigerant liquid, which has been pressurized by the first pump 13, to a supercooled zone. The cooled refrigerant liquid is supplied to the ejector 11 as a drive flow (from point G to point D). A part of the refrigerant liquid may be returned from the first extractor 12 or the pipe 15*a* to the evaporator 21 (from point E to point A).

As can be understood from point D, point E, and point G, the pressure of the refrigerant mixture discharged from the ejector 11 is higher than the pressure of the refrigerant vapor sucked into the ejector 11 and lower than the pressure of the refrigerant liquid supplied to the ejector 11. In other words, the pressure at the outlet of the ejector 11 is higher than the pressure at the inlet of the second nozzle 41 of the ejector 11 and is lower than the pressure at the inlet of a first nozzle 40 of the ejector 11. Due to such a pressure relationship, the pressure of a refrigerant can be efficiently increased. With the present embodiment, the ejector 11 can function as a condenser.

The pressure at the outlet of the ejector 11 is, for example, in the range of 6 to 1000 kPaA. The pressure at the inlet of the second nozzle 41 of the ejector 11 is, for example, in the range of 5 to 15 kPaA. The pressure at the inlet of the first nozzle 40 of the ejector 11 is, for example, in the range of 300 to 1500 kPaA.

As can be understood by comparing FIG. 2 with FIG. 13, the work to be done by the compressor 31 in the cycle shown in FIG. 2 is smaller than the work to be done by the compressors 131 and 132 in the cycle shown in FIG. 13. In other words, with the present embodiment, the compression ratio of the compressor 31 can be reduced. For example, if water is used as a refrigerant, it is possible to reduce the compression ratio of the compressor 31 by about 30% by supplying a refrigerant liquid having a pressure in the range of several hundred kPa to several MPa to the ejector 11 as a drive flow.

In the cycle shown in FIG. 2, it seems that the amount of heat released by the first heat exchanger 14 is increased. However, because the amount of a refrigerant liquid that is circulated is reduced, there is not a significant difference between the amount of heat released by the cycle shown in FIG. 2 and the amount of heat released by the cycle shown in FIG. 13. Although the work of the first pump 13 is increased in the cycle shown in FIG. 2, when the work of the compressor 31 is taken into consideration, the efficiency (COP: coefficient of performance) of the heat pump apparatus 200 is equivalent to or higher than that of the existing refrigeration cycle apparatus 100.

Moreover, with the heat pump apparatus 200 according to the present embodiment, a refrigerant liquid having a higher temperature can be easily generated. In other words, the heat pump apparatus 200 can be used for cooling in various regions including comparatively warm regions to very hot regions, such as desert regions and tropical regions. When used for heating, the heat pump apparatus 200 provides the following advantage. There may be a limitation on the temperature of a refrigerant discharged from the compressor 31 in order to prevent demagnetization of permanent magnets of a motor of the compressor 31. With the present embodiment, however, because the ejector 11 can generate a high-temperature refrigerant liquid, a high-temperature heating operation can be performed while restricting the temperature of the refrigerant discharged from the compressor 31. Moreover, when the heat pump apparatus 200 is used not only for heating but also for supplying hot water, water having a higher temperature can be supplied.

A refrigerant liquid stored in the evaporator 21 is moved to the second heat exchanger 23 by the pump 22. The refrigerant liquid absorbs heat from a heating medium, such as room air, in the second heat exchanger 23, and then returns to the evaporator 21. The refrigerant liquid in the evaporator 21 boils under a reduced pressure and evaporates, and the resulting refrigerant vapor is sucked into the compressor 31.

In the heat pump apparatus 200 according to the present embodiment, a refrigerant whose saturated vapor pressure at room temperature is a negative pressure is used. For example, regarding a refrigerant including water as a main component, the volume of a refrigerant vapor is about 100000 times the volume of a refrigerant liquid. Therefore, if the refrigerant vapor enters the liquid path 15, a very large pumping power is required.

With the present embodiment, the refrigerant mixture generated by the ejector 11 is supplied to the first extractor 12, and the first extractor 12 extracts the refrigerant liquid from the refrigerant mixture. The first pump 13 is disposed in the liquid path 15 at a position between the liquid outlet of the first extractor 12 and the inlet of the first heat exchanger 14. The refrigerant liquid extracted by the first extractor 12 is moved to the first heat exchanger 14 by the first pump 13. With such a structure, the inside of the liquid path 15, which extends from the first extractor 12 to the ejector 11 via the first heat exchanger 14, can be filled with a refrigerant liquid, and the refrigerant liquid can be continuously moved to the first heat exchanger 14 and the ejector 11 by the first pump 13. In other words, a refrigerant vapor can be prevented from entering the liquid path 15.

Next, the structure of the ejector 11 will be described in detail. As can be understood from the Mollier diagram shown in FIG. 2, it is desirable that the ejector 11 have not only a function of increasing the pressure of a refrigerant but also a function of condensing the refrigerant. The detailed structure of the ejector 11 described below enables transfer of momentum between a refrigerant liquid and a refrigerant vapor to be efficiently performed, and thereby contributes to improvement of the aforementioned functions of the ejector 11.

Figure 3A:
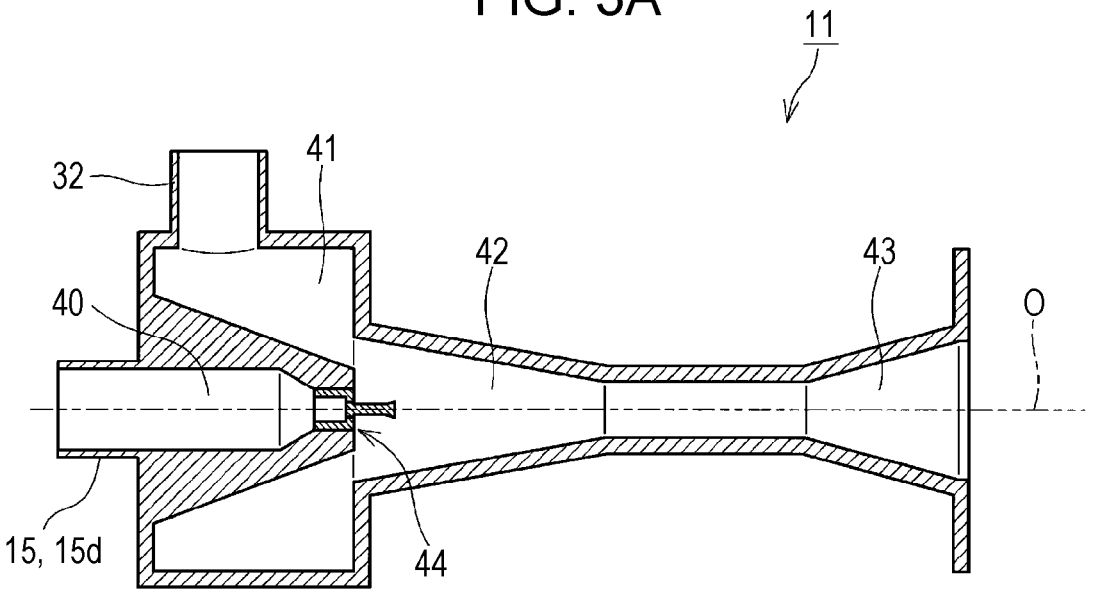
FIG. 3A is a sectional view of an ejector of the heat pump apparatus illustrated in FIG. 1.

As illustrated in FIG. 3A, the ejector 11 includes the first nozzle 40, the second nozzle 41, a mixer 42, a diffuser 43, and an atomization mechanism 44. The first nozzle 40 is a tubular portion disposed at a central part of the ejector 11. A refrigerant liquid (working fluid in a liquid phase) is supplied to the first nozzle 40 as a drive flow. The second nozzle 41 forms a ring-shaped space around the first nozzle 40. A refrigerant vapor (working fluid in a gas phase) is sucked into the second nozzle 41. The mixer 42 is a tubular portion connected to the first nozzle 40 and the second nozzle 41. The atomization mechanism 44 is disposed at an end of the first nozzle 40 so as to face the mixer 42. The atomization mechanism 44 has a function of atomizing the refrigerant liquid while maintaining a liquid phase. The atomized refrigerant generated by the atomization mechanism 44 and the refrigerant vapor sucked into the second nozzle 41 are mixed in the mixer 42, and thereby a refrigerant mixture (fluid mixture) is generated. The diffuser 43 is a tubular portion that is connected to the mixer 42 and that has an opening through which the refrigerant mixture is discharged to the outside of the ejector 11. The inside diameter of the diffuser 43 gradually increases from the upstream side to the downstream side. The velocity of the refrigerant mixture is reduced in the diffuser 43, and thereby the static pressure of the refrigerant mixture recovers. The first nozzle 40, the second nozzle 41, the mixer 42, the diffuser 43, and the atomization mechanism 44 have a common central axis O.

Figure 3B:
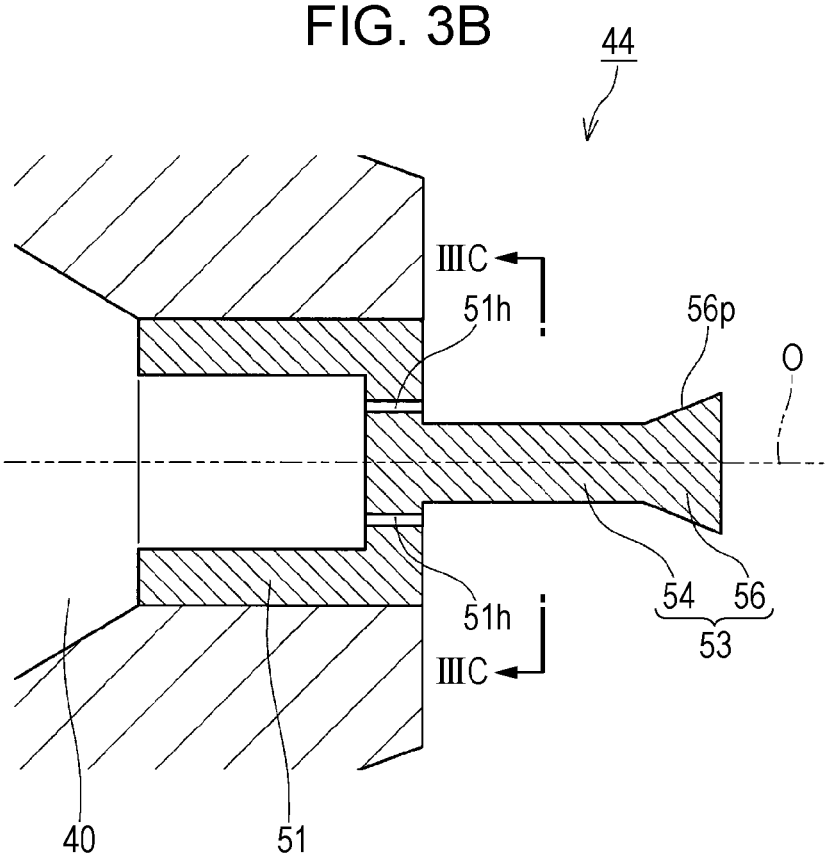
FIG. 3B is an enlarged sectional view of an atomization mechanism of the ejector illustrated in FIG. 3A.

As illustrated in FIG. 3B, the atomization mechanism 44 includes an ejection section 51 and a collision surface forming section 53. The ejection section 51 is attached to an end of the first nozzle 40. The ejection section 51 has a plurality of orifices 51*h*. The orifices 51*h* extend through a bottom part of the ejection section 51, which has a tubular shape, so as to connect the first nozzle 40 to the mixer 42. Through the orifices 51*h*, a refrigerant liquid is ejected from the first nozzle 40 toward the collision surface forming section 53. In other words, the ejection section 51 can generate a jet of the refrigerant liquid. The collision surface forming section 53 has a collision surface 56*p*, with which the jet from the ejection section 51 is to collide. In the present embodiment, the collision surface forming section 53 includes a shaft portion 54 and a flared portion 56. The shaft portion 54 is integrated with the ejection section 51 and has a cylindrical shape. The flared portion 56 is disposed at an end of the shaft portion 54 and has a flared shape. The flared portion 56 forms the collision surface 56*p*. Such a structure enables the collision surface 56*p* to be disposed in the mixer 42 without blocking the path of a refrigerant vapor. The collision surface 56*p* is inclined with respect the direction in which the jet flows. When colliding with the collision surface 56*p*, the jet is atomized due to the impact of collision, and the direction of the jet is changed in the direction in which the collision surface 56*p* is inclined. The atomized refrigerant liquid and a refrigerant vapor are mixed in the mixer 42. Because the collision surface 56*p* is inclined with respect to the direction of the jet, the collision surface 56*p* receives a drag force in accordance with the inclination angle. In other words, by forming the collision surface 56*p* so as to be inclined, occurrence of a loss of the momentum of the refrigerant liquid can be suppressed. In the present embodiment, the collision surface 56*p* has a conical shape.

Figure 3C:
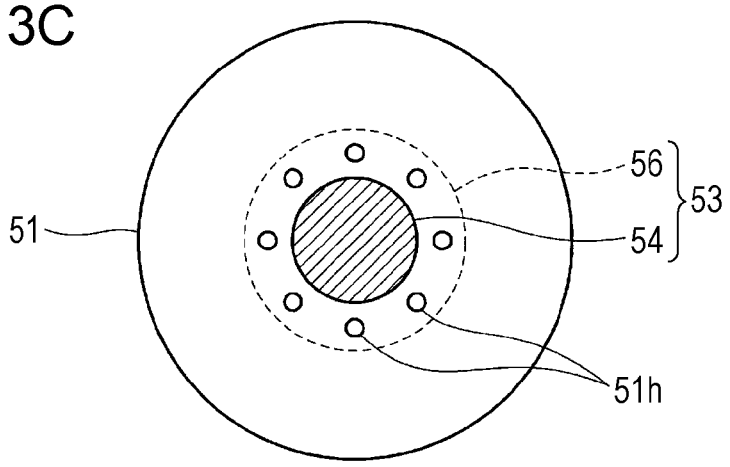
FIG. 3C is a cross-sectional view of the atomization mechanism of the ejector illustrated in FIG. 3A, taken along line IIIC-IIIC.

As illustrated in FIGS. 3B and 3C, in the present embodiment, the orifices 51*h* are arranged around the central axis O of the first nozzle 40 at regular intervals so as to surround the central axis O. Each of the orifices 51*h* extends in the direction parallel to the central axis O. Such a structure enables the atomized refrigerant liquid to be evenly supplied to the mixer 42. By ejecting the refrigerant liquid from the orifices 51*h*, a jet having a sufficient momentum can be made to collide with the collision surface 56*p*. By using the orifices 51*h*, it is possible to make the refrigerant liquid flow at a sufficiently high flow rate.

Figure 3D:
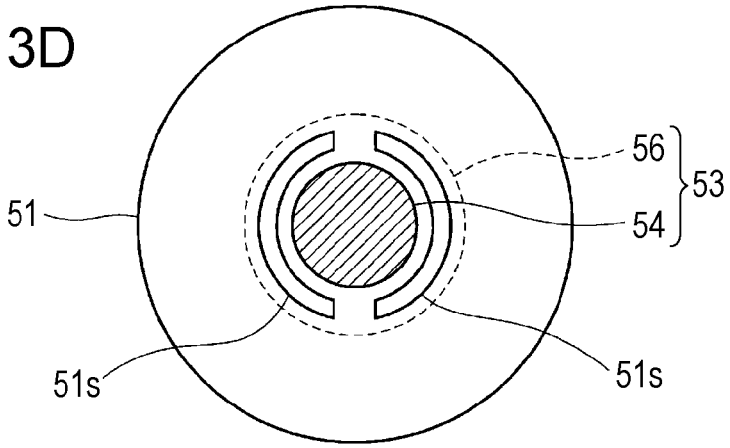
FIG. 3D is a cross-sectional view of an atomization mechanism having slits instead of orifices.

As illustrated in FIG. 3D, the ejection section 51 of the atomization mechanism 44 may have at least one slit 51*s* instead of the orifices 51*h*. In the example shown in FIG. 3D, a plurality of slits 51*s* (to be specific, two slits 51*s*) are formed in the ejection section 51. The slits 51*s* are arranged around the central axis O of the first nozzle 40 at regular intervals so as to surround the central axis O. Each of the slits 51*s* has an arc-like shape in plan view. Each of the slits 51*s* extends in the direction parallel to the central axis O. The slits 51*s* function in the same way as the orifices 51*h*.

As described above, the orifices 51*h* can be replaced with the slit 51*s*. Further alternatively, the orifices 51*h* and the slit 51*s* may coexist. Descriptions about the orifices in the following parts of the present specification also apply to the slits unless the descriptions are technologically contradictory. Likewise, descriptions about the slits also apply to the orifices unless the descriptions are technologically contradictory.

The cross-sectional shapes of the orifices 51*h*, the number of the orifices 51*h*, and the like are not particularly limited. The cross-sectional shapes, the sizes, and the number of the orifices 51*h* are determined so that a refrigerant liquid can pass through the orifices 51*h* at a sufficiently high flow rate. In the present embodiment, the cross-sectional shape of each of the orifices 51*h* in a plane perpendicular to the longitudinal direction is circular. The cross-sectional area of each of the orifices 51*h* is constant in the direction parallel to the central axis O (direction of flow of the refrigerant liquid). In other words, the opening area of each of the orifices 51*h* at an upstream end in the direction parallel to the central axis O is the same as the opening area of the orifice 51*h* at a downstream end. The cross-sectional shape of each of the orifices 51*h* is constant in the direction parallel to the central axis O. Accordingly, the phase of the refrigerant liquid does not easily change from a liquid phase to a gas-liquid two-phase when the refrigerant liquid passes through the orifice 51*h*. The inside diameter of each of the orifices 51*h* (the width of each of the slits 51*s*) is, for example, in the range of 50 to 500 μm.

However, the inside diameter of each of the orifices 51*h* may gradually increase from the upstream side toward the downstream side. It can be assumed that the inside diameter of each of the orifices 51*h* is constant as long as change of a refrigerant into a gas-liquid two-phase when passing through the orifice 51*h* can be sufficiently suppressed.

Figure 3E:
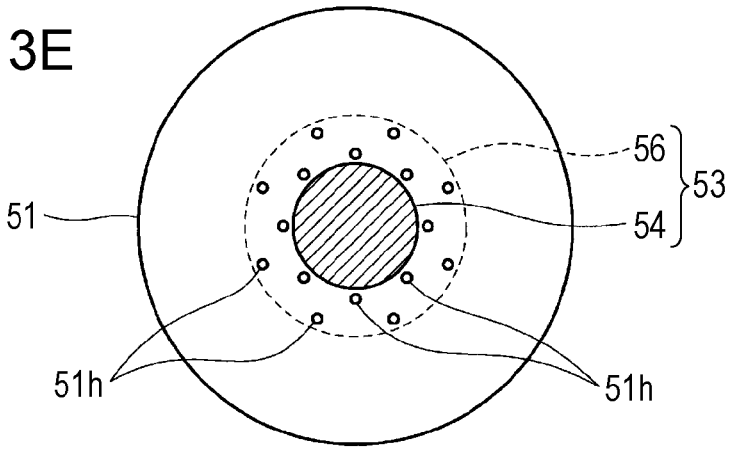
FIG. 3E is a cross-sectional view of an atomization mechanism having a plurality of orifices arranged along double circles.

In the example shown in FIG. 3C, the orifices 51*h* are arranged along a single circle, which imaginarily surrounds the central axis O. As illustrated in FIG. 3D, the slits 51*s* are also formed so as to have arc-shapes along a single circle, which imaginarily surrounds the central axis O. As illustrated in FIG. 3E, the orifices 51*h* (or the slit 51*s*) may be arranged along double circles, each of which imaginarily surrounds the central axis O. Such a structure enables the refrigerant liquid to flow at a sufficiently high flow rate. Moreover, it may be possible to accelerate atomization of the refrigerant liquid due to collision between a jet (inner jet) generated at the orifices 51*h* located near the central axis O and a jet (outer jet) generated at the orifices 51*h* located far from the central axis O. The collision surface 56*p* for the inner jet may be the same as the collision surface 56*p* for the outer jet. A dedicated collision surface may be provided for each of the inner jet and the outer jet.

It is not necessary that the orifices 51*h* located near the central axis O and the orifices 51*h* located far from the central axis O be arranged along concentric circles. These orifices 51*h* may be arranged at positions deviated from concentric circles.

In the present embodiment, the atomization mechanism 44 is a single-fluid atomization mechanism. As known by persons skilled in the art, the term "single-fluid" refers to a method that atomizes a refrigerant liquid by using the pressure of the refrigerant liquid, which is increased by using a pump. The structure of a single-fluid atomization mechanism is simple. Therefore, a single-fluid atomization mechanism is less expensive than a two-fluid type atomization mechanism.

The atomization mechanism 44 is structured so that a jet generated in the ejection section 51 may not directly collide with the inner wall of the mixer 42. To be specific, in the present embodiment, the central axis of each of the orifices 51*h* is parallel to the central axis O of the first nozzle 40. Therefore, it is impossible for a jet from the ejection section 51 to directly collide with the inner wall of the mixer 42. Thus, occurrence of a loss of the momentum of the jet due to direct collision of the jet with the inner wall of the mixer 42 can be avoided. The central axis of each of the orifices 51*h* may be inclined with respect to the central axis O of the first nozzle 40. By appropriately adjusting the position and the area of the collision surface 56*p*, it is possible to avoid direct collision of the jet with the inner wall of the mixer 42.

Figure 4:
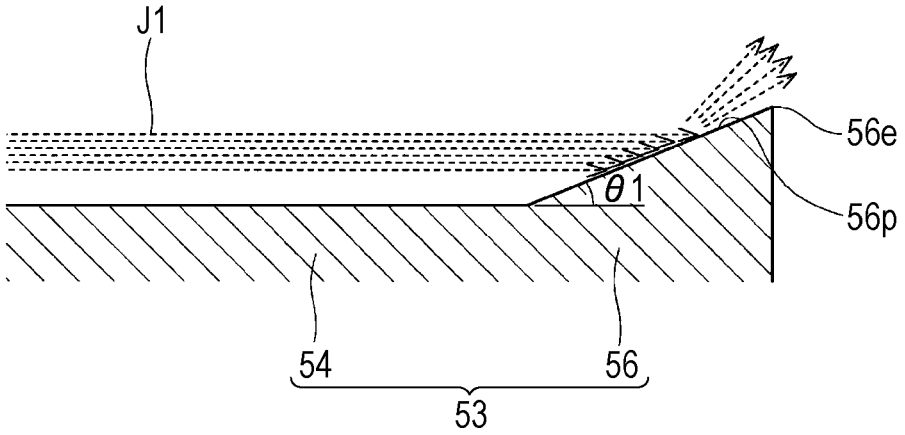
FIG. 4 is a schematic view illustrating the positional relationship between a jet and a collision surface.

In the present embodiment, the positional relationship between the ejection section 51 and the collision surface 56*p* is determined so that the entirety of a jet J1 from the ejection section 51 can collide with the collision surface 56*p* as illustrated in FIG. 4. In other words, the jet J1 is located inside of an outer edge 56*e* of the collision surface 56*p* (near the central axis O) in a direction perpendicular to the central axis O (the radial direction of the mixer 42). With such a positional relationship, the jet J1 can be efficiently atomized, and therefore the potential of the ejector 11 can be fully exploited. As a result, the efficiency of the cycle can be increased to the maximum. If a part of the jet J1 is deviated from the collision surface 56*p*, the part of the jet J1 is discharged to the mixer 42 without being atomized. As a result, the efficiency of transfer of momentum from the refrigerant liquid to the refrigerant vapor is reduced.

The refrigerant liquid (jet J1) ejected from the ejection section 51, which forms a liquid column, is in an unstable state due to the Rayleigh-Taylor instability. A microspray flow is generated when the jet J1 collides with the collision surface 56*p*.

The direction of flow of the jet J1 is substantially parallel to the central axis O of the first nozzle 40. For example, the angle θ1 between the direction of flow of the jet J1 and the collision surface 56*p* satisfies a relationship $0° < \theta 1 < 90°$. When the angle θ1 is adjusted to be in this range, a spray flow generated due to the collision is injected into the mixer 42 with a narrow angle. In this case, the spray flow does not easily collide with the inner wall of the mixer 42, and therefore a loss of momentum is not likely to occur. The angle θ1 is, in other words, the inclination angle of the collision surface 56*p* with respect to the central axis O.

Next, the function of the ejector 11 in the heat pump apparatus 200 illustrated in FIG. 1 will be described in detail.

As illustrated in FIG. 1, the first nozzle 40 is connected to the first heat exchanger 14 through the pipe 15*d*. Through the pipe 15*d*, a supercooled refrigerant liquid, which flows from the first heat exchanger 14, is supplied to the first nozzle 40 as a drive flow. The vapor path 32 is connected to the second nozzle 41. The temperature of the refrigerant liquid, which is sprayed into the mixer 42 through the first nozzle 40 and the atomization mechanism 44, has been reduced by the first heat exchanger 14. Therefore, as the refrigerant liquid is sprayed from the atomization mechanism 44, the pressure in the mixer 42 becomes lower than the pressure in the vapor path 32. To be specific, the pressure in the mixer 42 becomes a saturation pressure corresponding to the temperature of the refrigerant liquid supplied to the first nozzle 40. As a result, through the vapor path 32, a refrigerant vapor having a pressure lower than the atmospheric pressure is continuously sucked into the second nozzle 41 while being expanded and accelerated. The refrigerant liquid, which has been sprayed from the atomization mechanism 44 while being accelerated, and the refrigerant vapor, which has been sprayed from the second nozzle 41 while being expanded and accelerated, are mixed in the mixer 42. Then, a refrigerant mixture having a small quality (dryness) is generated due to first condensation, which is caused by the difference between temperatures of the refrigerant liquid and the refrigerant vapor, and a second condensation, which is caused by a pressurizing effect resulting from transfer of energy between the refrigerant liquid and the refrigerant vapor and transfer of momentum between the refrigerant liquid and the refrigerant vapor. If the quality of the refrigerant mixture is not zero, a sharp increase in pressure occurs because the flow rate of the refrigerant mixture exceeds the sonic velocity of the two-phase flow, and concentration is further accelerated. The generated refrigerant mixture is a refrigerant in a liquid phase or in a gas-liquid two-phase having a very small quality. Subsequently, the diffuser 43 recovers the static pressure by decelerating the refrigerant mixture. With such a structure, the ejector 11 increases the temperature and the pressure of the refrigerant.

Hereinafter, some modifications of the ejector will be described. The descriptions of the ejector 11, which have been made with reference to FIGS. 3A and 3B, can be applied to the following modifications as long as they are not technologically contradictory. Descriptions of the following modifications can be applied not only to the ejector 11 but also to each other as long as they are not technologically contradictory.

First Modification

Figure 5A:
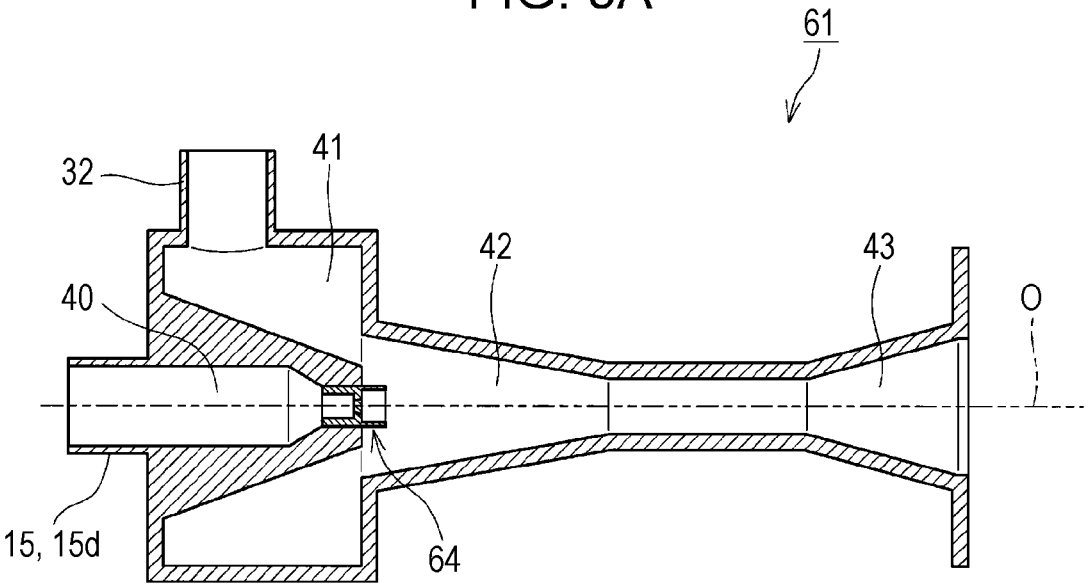
FIG. 5A is a sectional view of an ejector according to a first modification.

As illustrated in FIG. 5A, an ejector 61 according to a first modification includes an atomization mechanism 64, which is structured differently from the atomization mechanism 44 of the ejector 11 described above. However, the principle behind atomization of a refrigerant liquid is the same for both of the atomization mechanism 44 and the atomization mechanism 64. The function of the ejector 61 according to present modification is the same as that of the ejector 11 described above. Except for the structure of the atomization mechanism 64, the structure of the ejector 61 is the same as that of the ejector 11. As with the ejector 11, the ejector 61 can be appropriately used in the heat pump apparatus 200 (FIG. 1).

Figure 5B:
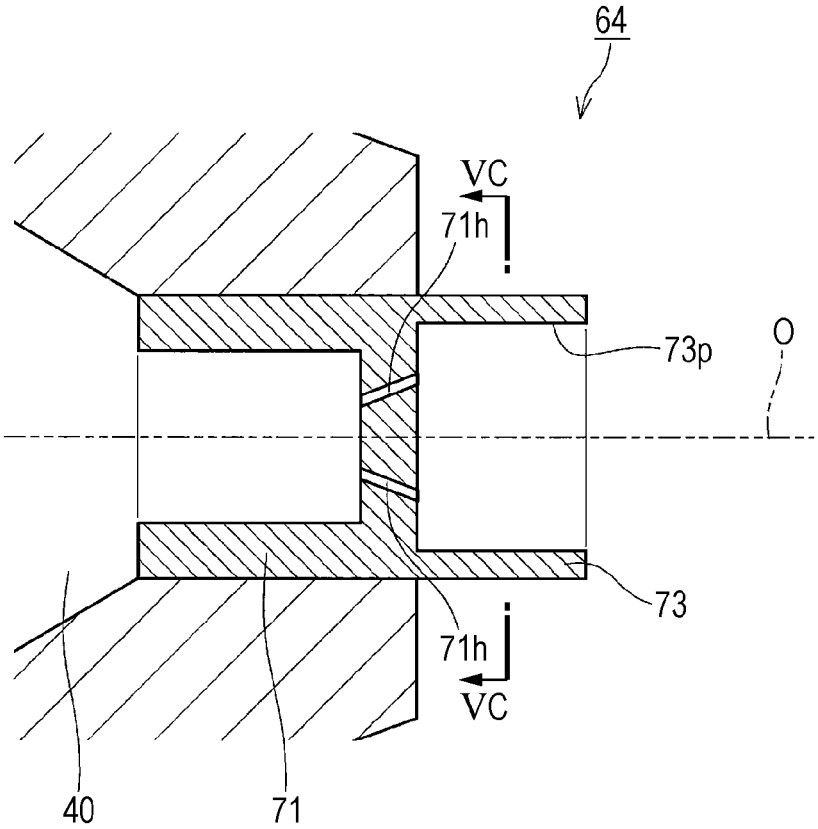
FIG. 5B is an enlarged sectional view of an atomization mechanism of the ejector illustrated in FIG. 5A.

As illustrated in FIGS. 5A and 5B, in the ejector 61, the atomization mechanism 64 is disposed at an end of the first nozzle 40 so as to face the mixer 42. The atomization mechanism 64 includes an ejection section 71 and a collision surface forming section 73. The ejection section 71 is attached to an end of the first nozzle 40. The ejection section 71 has a plurality of orifices 71*h*. The orifices 71*h* extend through a bottom part of the ejection section 71, which has a tubular shape, so as to connect the first nozzle 40 to the mixer 42. Through the orifices 71*h*, a refrigerant liquid is ejected from the first nozzle 40 toward the collision surface forming section 73. In other words, the ejection section 71 can generate a jet of the refrigerant liquid. The collision surface forming section 73 has a collision surface 73*p*, with which the jet from the ejection section 71 is to collide. The collision surface forming section 73 is a tubular portion, which is integrally formed with the ejection section 71. The collision surface 73*p* is formed by an inner peripheral surface of the collision surface forming section 73, which has a tubular shape. The collision surface 73*p* is inclined with respect to the direction in which the jet flows. When colliding with the collision surface 73*p*, the jet is atomized due to the impact of the collision, and the direction of the jet is changed in the direction in which the collision surface 73*p* is inclined. The atomized refrigerant liquid and a refrigerant vapor are mixed in the mixer 42.

Figure 5C:
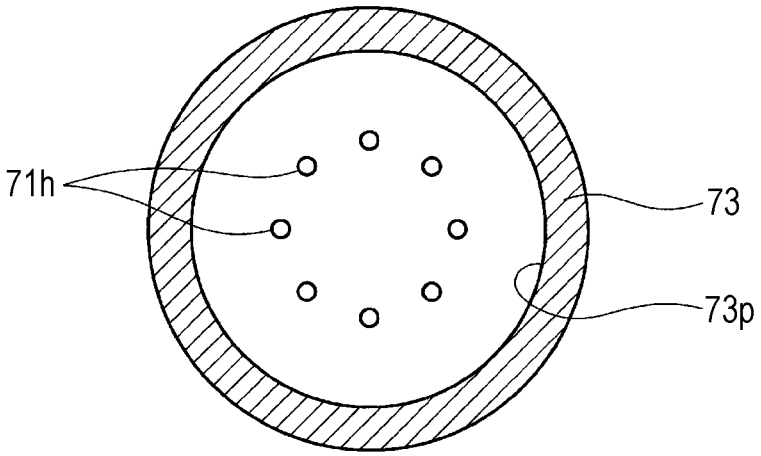
FIG. 5C is a cross-sectional view of the atomization mechanism of the ejector illustrated in FIG. 5A, taken along line VC-VC.

As illustrated in FIGS. 5B and 5C, the orifices 71*h* are arranged around the central axis O of the first nozzle 40 at regular intervals so as to surround the central axis O. Each of the orifices 71*h* extends in a direction that is inclined with respect to the central axis O. The collision surface 73*p* is a cylindrical surface that surrounds the central axis O at a position that is farther from the central axis O than the positions at which the orifices 71*h* are disposed. The central axis of the collision surface forming section 73 is the same as the central axis O of the first nozzle 40. Such a structure enables the atomized refrigerant liquid to be evenly supplied to the mixer 42. By ejecting the refrigerant liquid from the orifices 71*h*, it is possible to make a jet having a sufficient momentum to collide with the collision surface 73*p*. By using the orifices 71*h*, it is possible to make the refrigerant liquid flow at a sufficiently high flow rate. In FIGS. 5B and 5C, the collision surface 73*p* of the collision surface forming section 73 extends in the direction parallel to the central axis O. However, the collision surface 73*p* may extend in a direction that is inclined with respect to the central axis O.

Figure 5D:
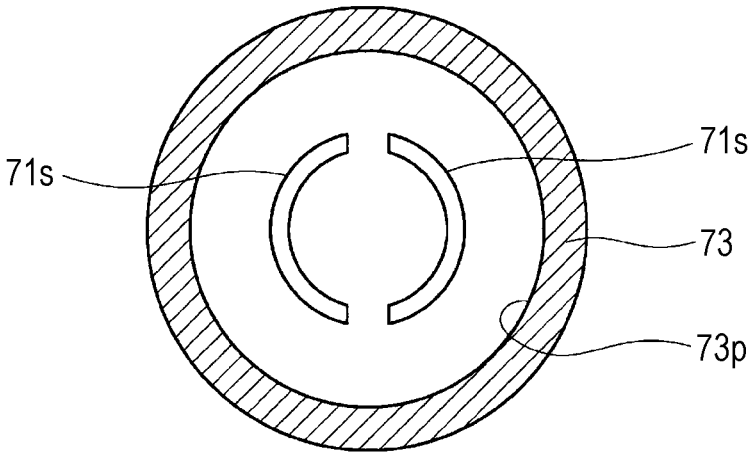
FIG. 5D is a cross-sectional view of an atomization mechanism having slits instead of orifices.

As illustrated in FIG. 5D, the ejection section 71 of the atomization mechanism 64 may have at least one slit 71*s* instead of the orifices 71*h*. In the modification shown in FIG. 50, a plurality of slits 71*s* (to be specific, two slits 71*s*) are formed in the ejection section 71. The slits 71*s* are arranged around the central axis O of the first nozzle 40 at regular intervals so as to surround the central axis O. Each of the slits 71*s* has an arc-like shape in plan view. Each of the slits 71*s* extends in a direction that is inclined with respect to the central axis O. The slits 71*s* function in the same way as the orifices 71*h*.

Except that the orifices 71*h* and the slit 71*s* extend in directions that are inclined with respect to the central axis O, the detailed structures of the orifices 71*h* and the slit 71*s* are the same as those of the orifices 51*h* and the slits 51*s* described above.

Figure 6:
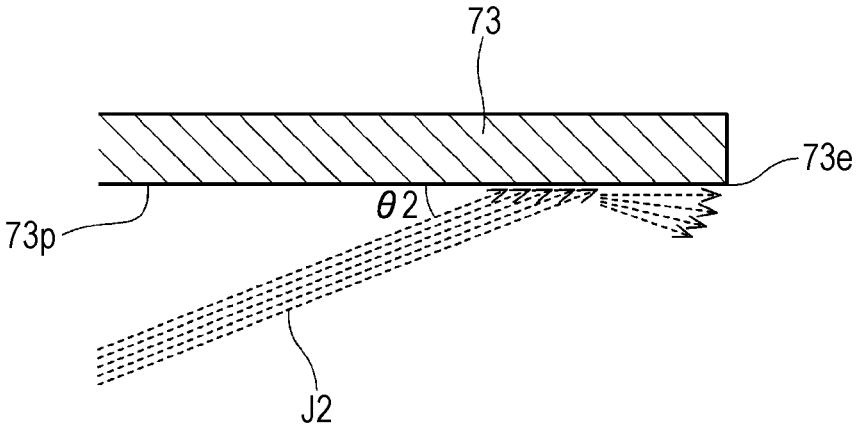
FIG. 6 is a schematic view illustrating the positional relationship between a jet and a collision surface.

Also in the present modification, the atomization mechanism 64 is structured so that a jet generated in the ejection section 71 may not directly collide with the inner wall of the mixer 42. To be specific, the positional relationship between the ejection section 71 and the collision surface 73*p* is determined so that the entirety of a jet J2 from the ejection section 71 can collide with the collision surface 73*p* as illustrated in FIG. 6. In other words, the jet J2 is located upstream of a downstream end 73*e* of the collision surface 73*p* in the direction parallel to the central axis O. With such a positional relationship, the jet J2 can be efficiently atomized, and therefore the potential of the ejector 61 can be fully exploited. As a result, the efficiency of the cycle can be increased to the maximum.

The refrigerant liquid (jet J2) ejected from the ejection section 71, which forms a liquid column, is in an unstable due to the Rayleigh-Taylor instability. A microspray flow is generated when the jet J2 collides with the collision surface 73*p*.

The direction of flow of the jet J2 is inclined with respect to the central axis O of the first nozzle 40. For example, the angle θ2 between the direction of flow of the jet J2 and the collision surface 73*p* satisfies a relationship $0° < \theta 2 < 90°$. When the angle θ2 is adjusted to be in this range, a spray flow generated due to the collision is injected into the mixer 42 with a narrow angle. In this case, the spray flow does not easily collide with the inner wall of the mixer 42, and therefore a loss of momentum is not likely to occur.

In particular, in the present modification, the collision surface 73*p* is parallel to the central axis O of the first nozzle 40. In this case, a spray flow generated at the collision surface 73*p* is discharged in a direction substantially parallel to the central axis O. As a result, the aforementioned advantage can be sufficiently obtained. The angle between the collision surface 73*p* and the central axis O is not limited to 0 degrees. For example, the angle between the collision surface 73*p* and the central axis O is larger than 0° and smaller than 90°. In other words, the inside diameter of the collision surface forming section 73 may continuously increase toward the downstream side.

Second Modification

Figure 7A:
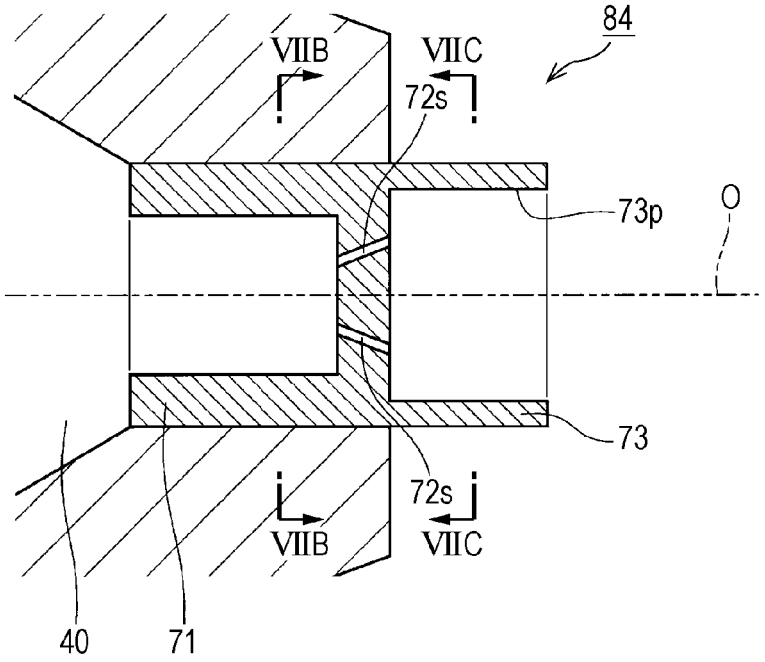
FIG. 7A is an enlarged sectional view of an atomization mechanism according to a second modification.
Figure 7B:
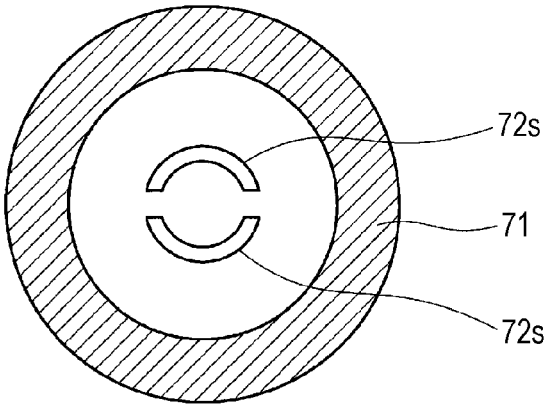
FIG. 7B is a cross-sectional view of the atomization mechanism according to the second modification, taken along line VIIB-VIIB.
Figure 7C:
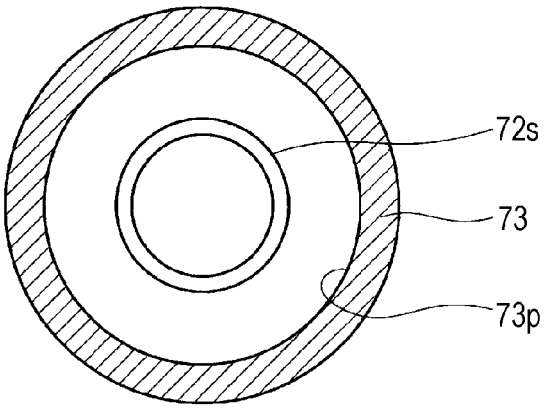
FIG. 7C is a cross-sectional view of the atomization mechanism according to the second modification, taken along line VIIC-VIIC.

As illustrated in FIGS. 7A to 7C, an atomization mechanism 84 according to a second modification includes the ejection section 71 and the collision surface forming section 73. The structures of these elements are the same as those of the first modification. The ejection section 71 has a slit 72*s*. When seen in plan view from the first nozzle 40 side, the slit 72*s* is divided into a plurality of portions (two arc-shaped portions) (FIG. 7B). When seen in plan view from the mixer 42 side, the slit 72*s* has a ring-like shape (FIG. 7C). In other words, the cross-sectional shape of the slit 72*s* changes in a direction parallel to the central axis O. As in this case, the cross-sectional shape of the slit (or an orifice) of the ejection section 71 may change in the direction parallel to the central axis O. Moreover, the cross-sectional area of the slit (or an orifice) of the ejection section 71 may change in the direction parallel to the central axis O. Such a structure can be also applied to the ejector 11 described above with reference to FIGS. 3A to 3D. Furthermore, as described above with reference to FIG. 5D, if the ejection section 71 has the slits 71*s*, which extend in directions that are inclined with respect to the central axis O, the cross-sectional shape of each of the slits 71*s* may change in the direction parallel to the central axis O as in the present modification.

Third Modification

Figure 8A:
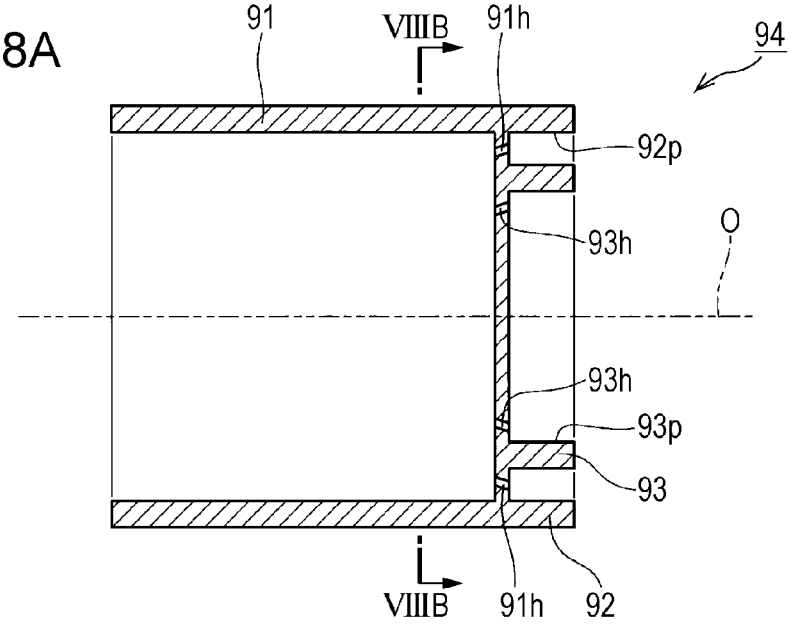
FIG. 8A is an enlarged sectional view of an atomization mechanism according to a third modification.
Figure 8B:
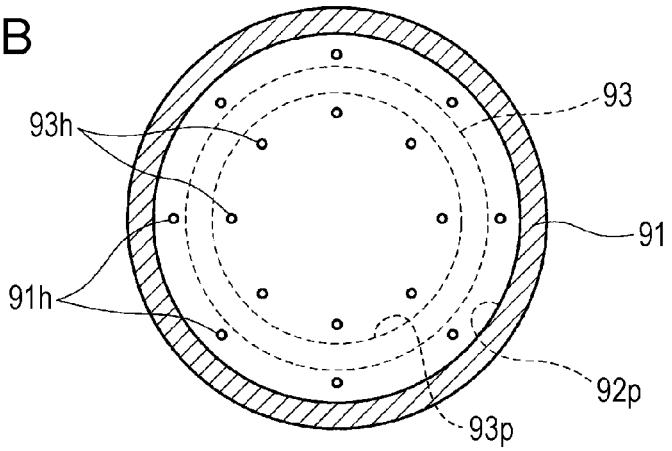
FIG. 8B is a cross-sectional view of the atomization mechanism according to the third modification, taken along line VIIIB-VIIIB.

As illustrated in FIGS. 8A and 8B, an atomization mechanism 94 according to a third modification includes an ejection section 91, a collision surface forming section 92, and a collision surface forming section 93. The ejection section 91 is attached to an end of the first nozzle 40. The ejection section 91 has a plurality of orifices 91*h* (first orifices) and a plurality of orifices 93*h* (second orifices). The orifices 91*h* and 93*h* extend through a bottom part of the ejection section 91, which has a tubular shape, so as to connect the first nozzle 40 to the mixer 42. Through the orifices 91*h* and 93*h*, a refrigerant liquid is ejected from the first nozzle 40 toward the collision surface forming sections 92 and 93. In other words, the ejection section 91 can generate a jet of the refrigerant liquid.

The orifices 91*h* are located at positions that are relatively far from the central axis O of the first nozzle 40. The orifices 93*h* are located at positions that are relatively near the central axis O. To be specific, the orifices 91*h* and 93*h* are arranged along double circles, each of which imaginarily surrounds the central axis O. Such a structure enables the refrigerant liquid to flow at a sufficiently high flow rate. This structure can be also used in the atomization mechanisms 44, 64, and 84 described above.

The atomization mechanism 94 according to the present modification includes the collision surface forming sections 92 and 93. The collision surface forming sections 92 and 93 are respectively disposed at a position relatively far from the central axis O and at a position relatively near the central axis O. Each of the collision surface forming sections 92 and 93 is a tubular portion that is integrally formed with the ejection section 91. The collision surface forming section 92 corresponds to the orifices 91*h* that are located far from the central axis O. In other words, the collision surface forming section 92 is an outer portion having a collision surface 92*p*, with which a jet from the orifices 91*h* is to collide. The collision surface 92*p* is formed by an inner peripheral surface of the collision surface forming section 92, which has a tubular shape. The collision surface forming section 93 corresponds to the orifices 93*h* that are located near the central axis O. In other words, the collision surface forming section 93 is an inner portion having a collision surface 93*p*, with which a jet from the orifices 93*h* is to collide. The collision surface 93*p* is formed by an inner peripheral surface of the collision surface forming section 93, which has a tubular shape. Each of the collision surface 92*p* and 93*p* is inclined with respect to a direction in which a corresponding jet flows. When colliding with the collision surface 92*p*, the jet is atomized due to the impact of the collision, and the direction of the jet is changed in the direction in which the collision surface 92*p* is inclined. Likewise, when colliding with the collision surface 93*p*, the jet is atomized due to the impact of the collision and the direction of the jet is changed in the direction in which the collision surface 93*p* is inclined. The atomized refrigerant liquid and a refrigerant vapor are mixed with each other in the mixer 42. The orifices 91*h* may be inclined in such directions that the jet from the orifices 91*h* can collide with an outer peripheral surface of the collision surface forming section 93. In this case, the collision surface forming section 92 on the outer side can be omitted.

Each of the orifices 91*h* and 93*h* extends in a direction that is inclined with respect to the central axis O. Each of the collision surfaces 92*p* and 93*p* is parallel to the central axis O of the first nozzle 40. In other words, except that the collision surface forming section 93 and the orifices 93*h* are additionally provided, the structure of the present modification is the same as that of the first modification. Accordingly, the present modification provides the same advantage as the first modification.

Also in the present modification, the atomization mechanism 94 is structured so that a jet generated by the ejection section 71 may not directly collide with the inner wall of the mixer 42. To be specific, as described above with reference to FIG. 6, the positional relationship between the ejection section 91 and the collision surface 92*p* or the positional relationship between the ejection section 91 and the collision surface 93*p* is determined so that the entirety of the jet from the ejection section 91 can collide with the collision surface 92*p* or 93*p*.

Figure 8C:
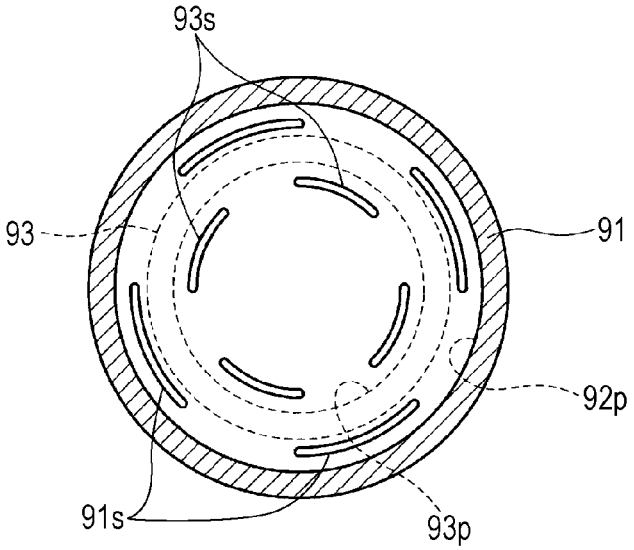
FIG. 8C is a cross-sectional view of an atomization mechanism having slits instead of orifices.

As illustrated in FIG. 8C, also in the present modification, slits 91*s* can be used instead of the orifices 91*h*. Slits 93*s* can be used instead of the orifices 93*h*. Each of the slits 93*s* may have an arc-like shape in plan view.

Another Embodiment

Figure 9:
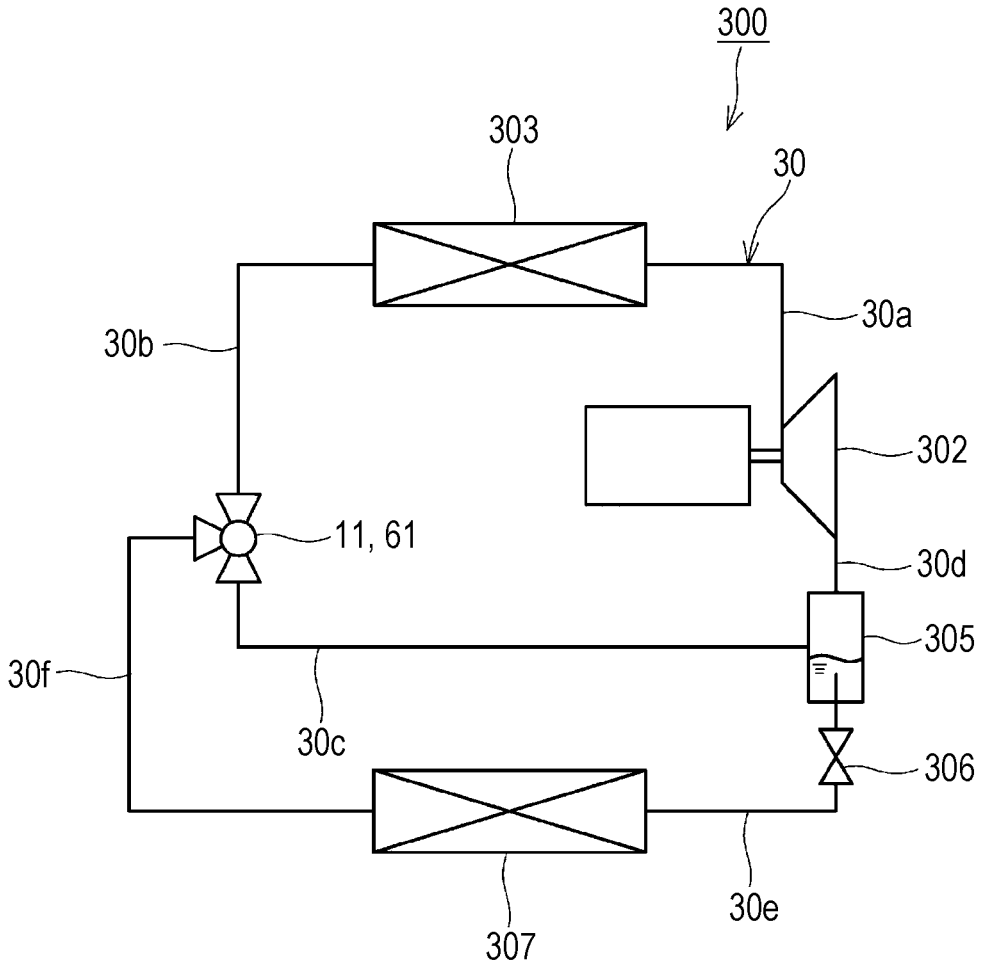
FIG. 9 is a block diagram of a heat pump apparatus according to another embodiment of the present disclosure.
Figure 10:
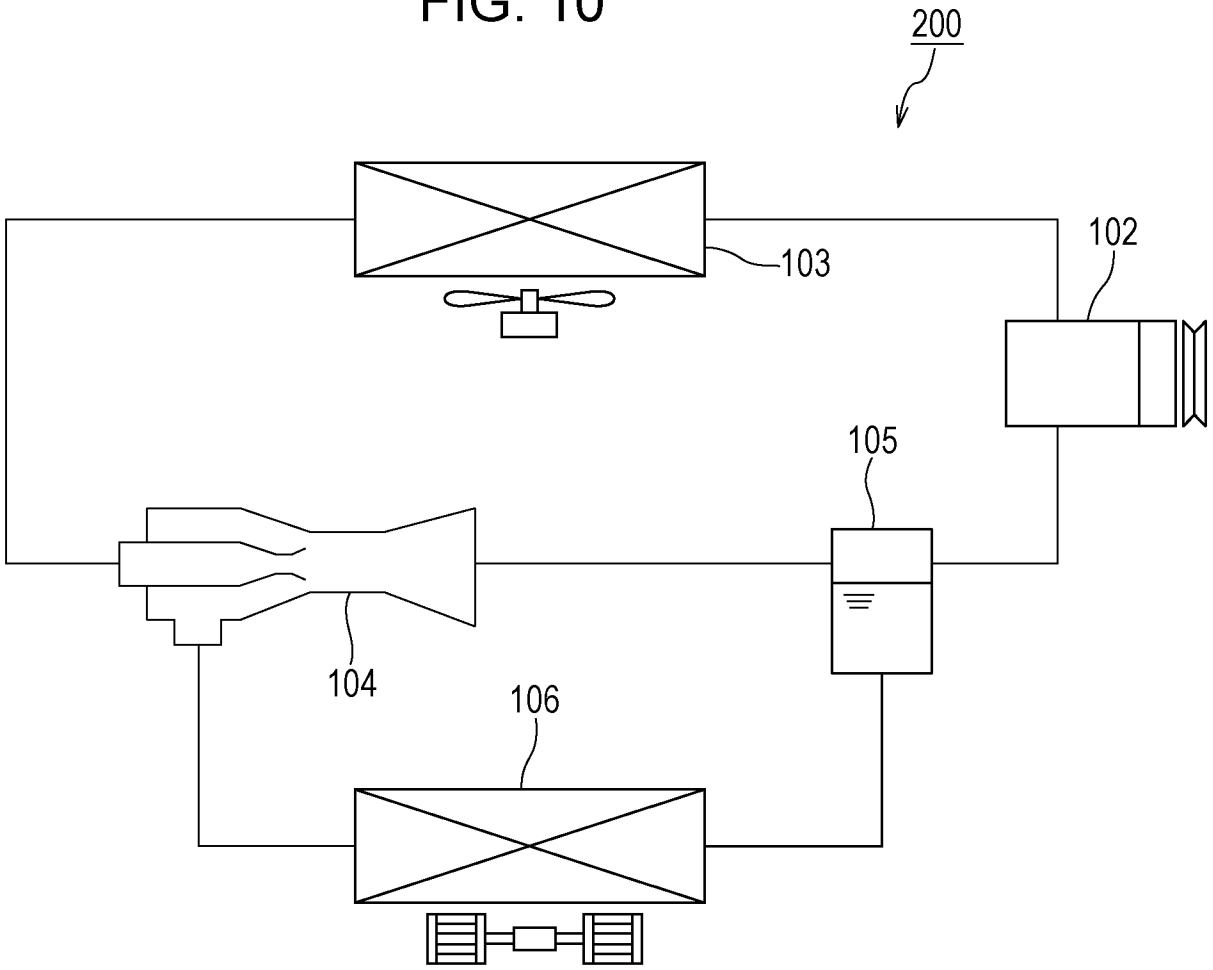
FIG. 10 is a block diagram of an existing refrigeration cycle apparatus.
Figure 11:
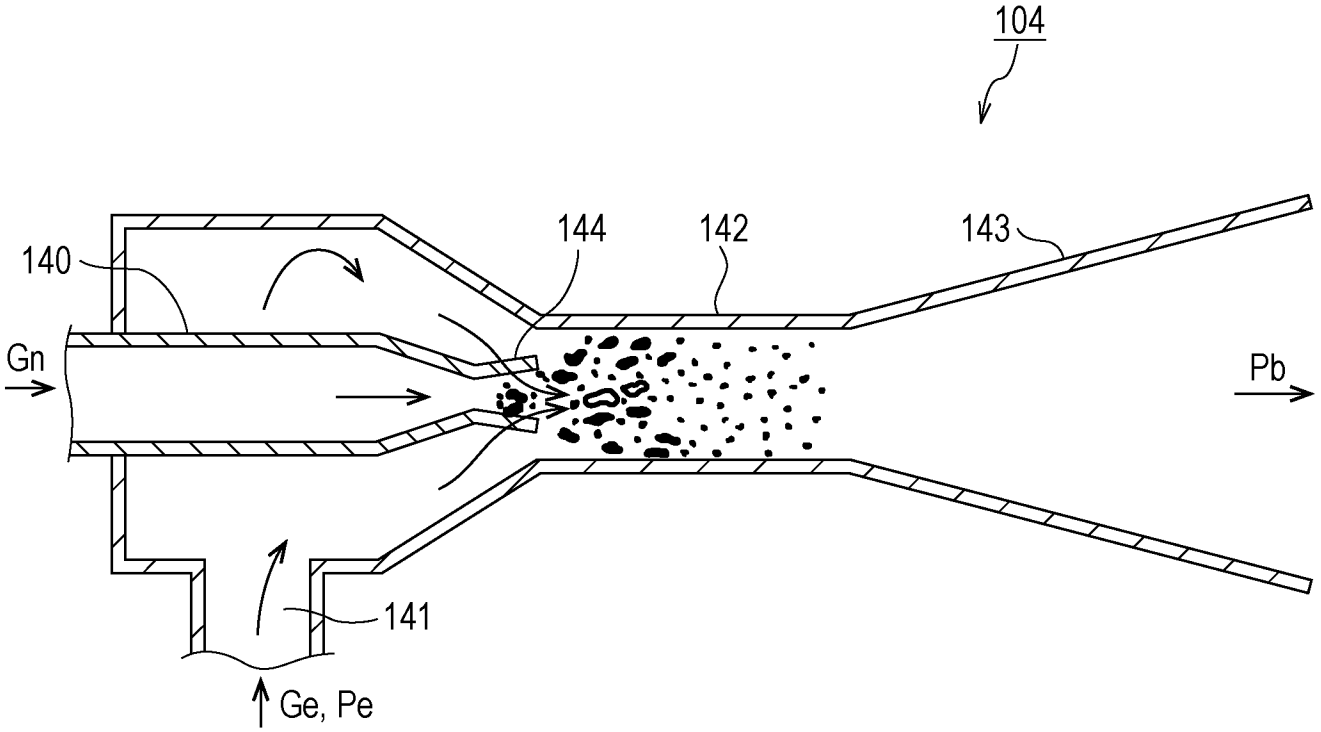
FIG. 11 is a sectional view of an ejector of the refrigeration cycle apparatus illustrated in FIG. 10.

The ejectors described in the present specification can be also used for a heat pump apparatus that uses a fluorocarbon resin, such as R410A, or a natural refrigerant, such as carbon dioxide. As illustrated in FIG. 9, a heat pump apparatus 300 according to the present embodiment includes a compressor 302, a radiator 303 (condenser), the ejector 11 (or 61), a vapor liquid separator 305, an expansion valve 306, and an evaporator 307. These elements are connected to each other through flow passages 30*a* to 30*f* so as to form a refrigerant circuit 30. Typically, the flow passages 30*a* to 30*f* include refrigerant pipes. The refrigerant circuit 30 is filled with a refrigerant, such as hydrofluorocarbon or carbon dioxide, as a working fluid. Other elements, such as an accumulator, may be disposed in the flow passages 30*a* to 30*f*. The expansion valve 306 may be omitted.

The flow passage 30*a* connects the compressor 302 to the radiator 303 so that a refrigerant compressed by the compressor 302 is supplied to the radiator 303. The flow passage 30*b* connects the radiator 303 to the ejector 11 so that the refrigerant flowing from the radiator 303 is supplied to the ejector 11. The flow passage 30*c* connects the ejector 11 to the vapor liquid separator 305 so that the refrigerant ejected from the ejector 11 is supplied to the vapor liquid separator 305. The flow passage 30*d* connects the vapor liquid separator 305 to the compressor 302 so that a refrigerant vapor separated by the vapor liquid separator 305 is supplied to the compressor 302. The flow passage 30*e* connects the vapor liquid separator 305 to the evaporator 307 so that a refrigerant liquid separated by the vapor liquid separator 305 is supplied to the evaporator 307. The flow passage 30*f* connects the evaporator 307 to the ejector 11 so that the refrigerant vapor flowing from the evaporator 307 is supplied to the ejector 11.

By using the ejector 11, the suction pressure of the compressor 302 can be increased to an intermediate pressure. As a result, a load applied to the compressor 302 is reduced, and the COP of the heat pump apparatus 300 is improved.

The ejector and the heat pump apparatus disclosed in the present specification are particularly effective for use in air-conditioning apparatuses, such as home air conditioners and office/factory air conditioners.

What is claimed is:

1. An ejector comprising: a first nozzle to which a working fluid in a liquid phase is supplied; a second nozzle into which a working fluid in a gas phase is sucked; an atomization mechanism that is disposed at an end of the first nozzle and that atomizes the working fluid in a liquid phase while maintaining the liquid phase; and a mixer that generates a fluid mixture by mixing the atomized working fluid generated by the atomization mechanism with the working fluid in a gas phase sucked into the second nozzle, wherein the atomization mechanism includes an ejection section that generates a jet of the working fluid in the liquid phase, and a collision surface with which the jet from the ejection section collides, and wherein the collision surface is inclined with respect to a direction in which the jet flows.

2. The ejector according to claim 1, wherein an entirety of the jet generated by the ejection section collides with the collision surface.

3. The ejector according to claim 1, wherein the ejection section includes a plurality of orifices.

4. The ejector according to claim 3, wherein the plurality of orifices are disposed around a central axis of the first nozzle, and each of the orifices extends in a direction parallel to the central axis.

5. The ejector according to claim 3, wherein the plurality of orifices are disposed around a central axis of the first nozzle, and each of the orifices extends in a direction inclined with respect to the central axis, and wherein the collision surface is a cylindrical surface that surrounds the central axis of the first nozzle at a position that is farther from the central axis than positions at which the plurality of orifices are disposed.

6. The ejector according to claim 3, wherein the plurality of orifices are arranged along double circles, each of which imaginarily surrounds a central axis of the first nozzle.

7. The ejector according to claim 3, wherein a cross-sectional area of each of the plurality of orifices is constant in a direction of flow of the working fluid.

8. The ejector according to claim 1, wherein the ejection section includes a slit.

9. The ejector according to claim 8, wherein the slit is disposed around a central axis of the first nozzle and extends in a direction parallel to the central axis of the first nozzle.

10. The ejector according to claim 8, wherein the slit is disposed around a central axis of the first nozzle and extends in a direction inclined with respect to the central axis, and wherein the collision surface is a cylindrical surface that surrounds the central axis of the first nozzle at a position that is farther from the central axis than a position at which the slit is disposed.

11. The ejector according to claim 8, wherein the slit is arranged along double circles, each of which imaginarily surrounds a central axis of the first nozzle.

12. The ejector according to claim 8, wherein a cross-sectional area of the slit is constant in a direction of flow of the working fluid.

13. The ejector according to claim 1, wherein the collision surface is disposed between the ejection section and an inner wall of the mixer and directs toward the inner wall a jet that is ejected from the ejection section and that is made to collide with the collision surface.

14. The ejector according to claim 1, wherein the atomization mechanism is a single-fluid atomization mechanism.

15. The ejector according to claim 1, further comprising a discharger that discharges the fluid mixture to the outside, wherein the discharger includes a diffuser that recovers a static pressure by decelerating the fluid mixture.

16. A heat pump apparatus comprising:

a compressor that compresses a refrigerant vapor;

a heat exchanger through which a refrigerant liquid flows;

the ejector according to claim 1, the ejector generating a refrigerant mixture by using the refrigerant vapor compressed by the compressor and the refrigerant liquid flowing from the heat exchanger;

an extractor that receives the refrigerant mixture from the ejector and that extracts the refrigerant liquid from the refrigerant mixture;

a liquid path that extends from the extractor to the ejector via the heat exchanger; and an evaporator that stores the refrigerant liquid and that generates the refrigerant vapor, which is to be compressed by the compressor, by evaporating the refrigerant liquid.

17. The heat pump apparatus according to claim 16, wherein a pressure of the refrigerant mixture discharged from the ejector is higher than a pressure of the refrigerant vapor sucked into the ejector and lower than a pressure of the refrigerant liquid supplied to the ejector.

18. The heat pump apparatus according to claim 16, wherein the refrigerant is a refrigerant whose saturated vapor pressure at room temperature is a negative pressure.

19. The heat pump apparatus according to claim 16, wherein the refrigerant includes water as a main component.

* * * * *